US010180279B2

(12) United States Patent
Yang et al.

(10) Patent No.: US 10,180,279 B2
(45) Date of Patent: Jan. 15, 2019

(54) REFRIGERATOR

(71) Applicant: LG Electronics Inc., Seoul (KR)

(72) Inventors: Changwoan Yang, Seoul (KR); Seungjin Choi, Seoul (KR); Hanhyo Kim, Seoul (KR); Yoomin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/550,541

(22) PCT Filed: Feb. 12, 2016

(86) PCT No.: PCT/KR2016/001454
§ 371 (c)(1),
(2) Date: Aug. 11, 2017

(87) PCT Pub. No.: WO2016/129960
PCT Pub. Date: Aug. 18, 2016

(65) Prior Publication Data

US 2018/0031308 A1 Feb. 1, 2018

(30) Foreign Application Priority Data

Feb. 13, 2015 (KR) ..... 10-2015-0022197
Jan. 5, 2016 (KR) ..... 10-2016-0001267
Jan. 5, 2016 (KR) ..... 10-2016-0001269

(51) Int. Cl.
*F25D 25/02* (2006.01)
*F25D 23/02* (2006.01)
*F25D 23/06* (2006.01)

(52) U.S. Cl.
CPC ..... *F25D 25/025* (2013.01); *F25D 23/02* (2013.01); *F25D 23/028* (2013.01); *F25D 23/067* (2013.01); *F25D 2323/024* (2013.01)

(58) Field of Classification Search
CPC . F25D 25/025; F25D 23/028; F25D 2323/024
See application file for complete search history.

(56) References Cited

U.S. PATENT DOCUMENTS 1,227,813 A * 5/1917 Mahoney ..... A47B 96/16 109/47
1,835,847 A * 12/1931 Chandler ..... F25D 25/02 126/340

(Continued)

FOREIGN PATENT DOCUMENTS

KR 10-2005-0060115 6/2005
KR 10-2005-0118585 12/2005

(Continued)

*Primary Examiner* — Hanh V Tran
(74) *Attorney, Agent, or Firm* — Fish & Richardson P.C.

(57) ABSTRACT

A refrigerator comprises: a cabinet including a storage chamber which has an opening formed on the front side thereof; a door pivotally connected to the cabinet so as to open and close the opening; a drawer disposed inside the storage chamber so as to receive stored goods; a drawer guide for supporting the drawer, and guiding the drawer such that the drawer can be moved forward and backward; a base part disposed below the drawer; a withdrawal mechanism including a rear frame which extends rearward of the drawer from the base part so as to push the drawer forward when the base part is moved forward; a link having a front end connected to the door at a point, which is positioned at a predetermined distance from the axis of rotation of the door with respect to the cabinet, so as to form a first rotary joint, and having a rear end connected to the base part so as to form a second rotary joint; and a pair of withdrawal mechanism guides disposed.

11 Claims, 16 Drawing Sheets

(56) References Cited

U.S. PATENT DOCUMENTS 2,095,811 A * 10/1937 Goulooze ..... F25D 25/024 126/337 R
2,761,751 A * 9/1956 Stockton ..... F25D 25/024 312/274
3,212,835 A * 10/1965 Beckett ..... E05F 1/1215 126/25 R
5,005,729 A * 4/1991 Hollman ..... B65F 1/1436 220/23.83
5,299,863 A * 4/1994 Albright, Jr. ..... F25D 25/024 312/404
5,474,374 A * 12/1995 Sandvig ..... A47B 77/18 312/271
5,810,462 A * 9/1998 Lee ..... F25D 25/027 312/130
6,220,682 B1 * 4/2001 Vertullo ..... A47B 46/00 312/334.24
6,253,568 B1 * 7/2001 Peffley ..... F25D 11/02 312/199
6,292,978 B1 9/2001 Lakoduk et al.
8,267,493 B2 * 9/2012 Kim ..... F25D 25/024 108/106
9,322,592 B2 * 4/2016 Kim ..... F25D 23/04
9,726,423 B1 * 8/2017 Swarnkar ..... F25D 25/024
2005/0275326 A1 * 12/2005 Lim ..... F25D 25/024 312/408
2010/0253191 A1 * 10/2010 Backhaus ..... A47B 96/16 312/309
2010/0307186 A1 * 12/2010 Kwon ..... F25D 23/028 62/407
2012/0031136 A1 * 2/2012 Park ..... F25D 11/02 62/340
2013/0257255 A1 * 10/2013 Hwang ..... F25D 23/02 312/404
2017/0234607 A1 * 8/2017 Yang ..... A47B 88/453 312/408

FOREIGN PATENT DOCUMENTS

KR 10-2010-0130357 12/2010
KR 10-2011-0046237 5/2011
KR 10-2014-0013718 2/2014

* cited by examiner

【FIG. 1】
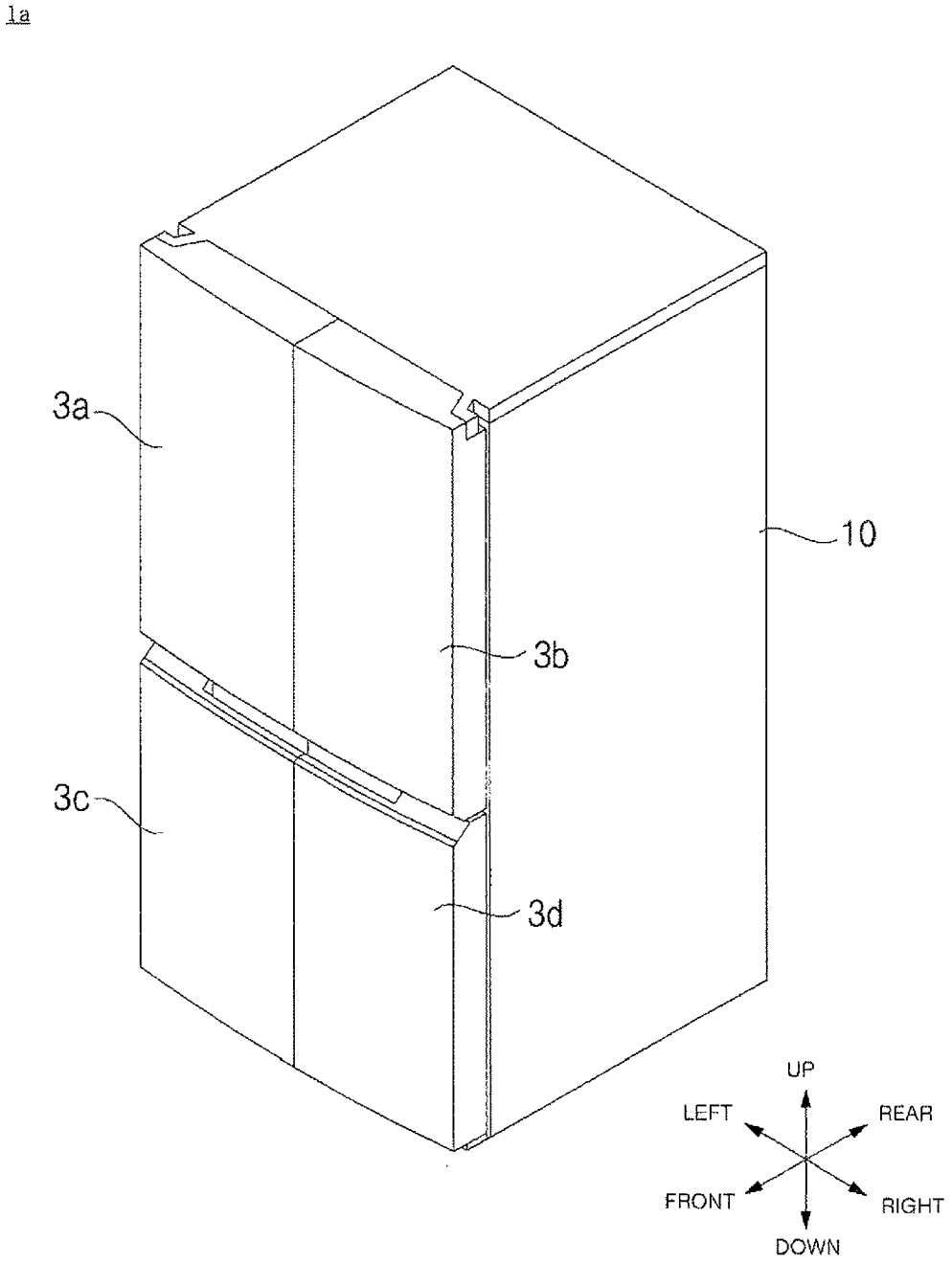

【FIG. 2】
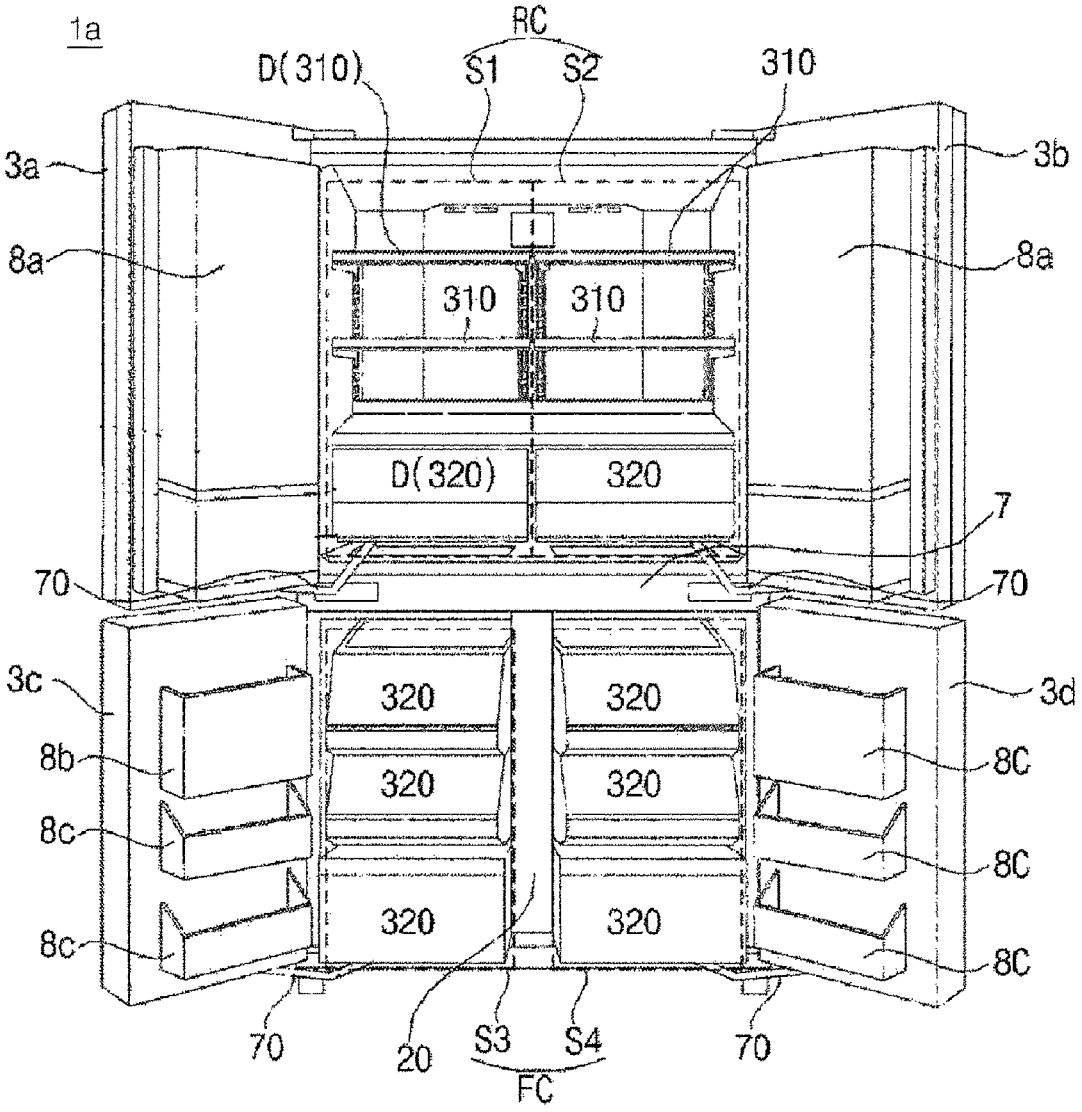

【FIG. 3】
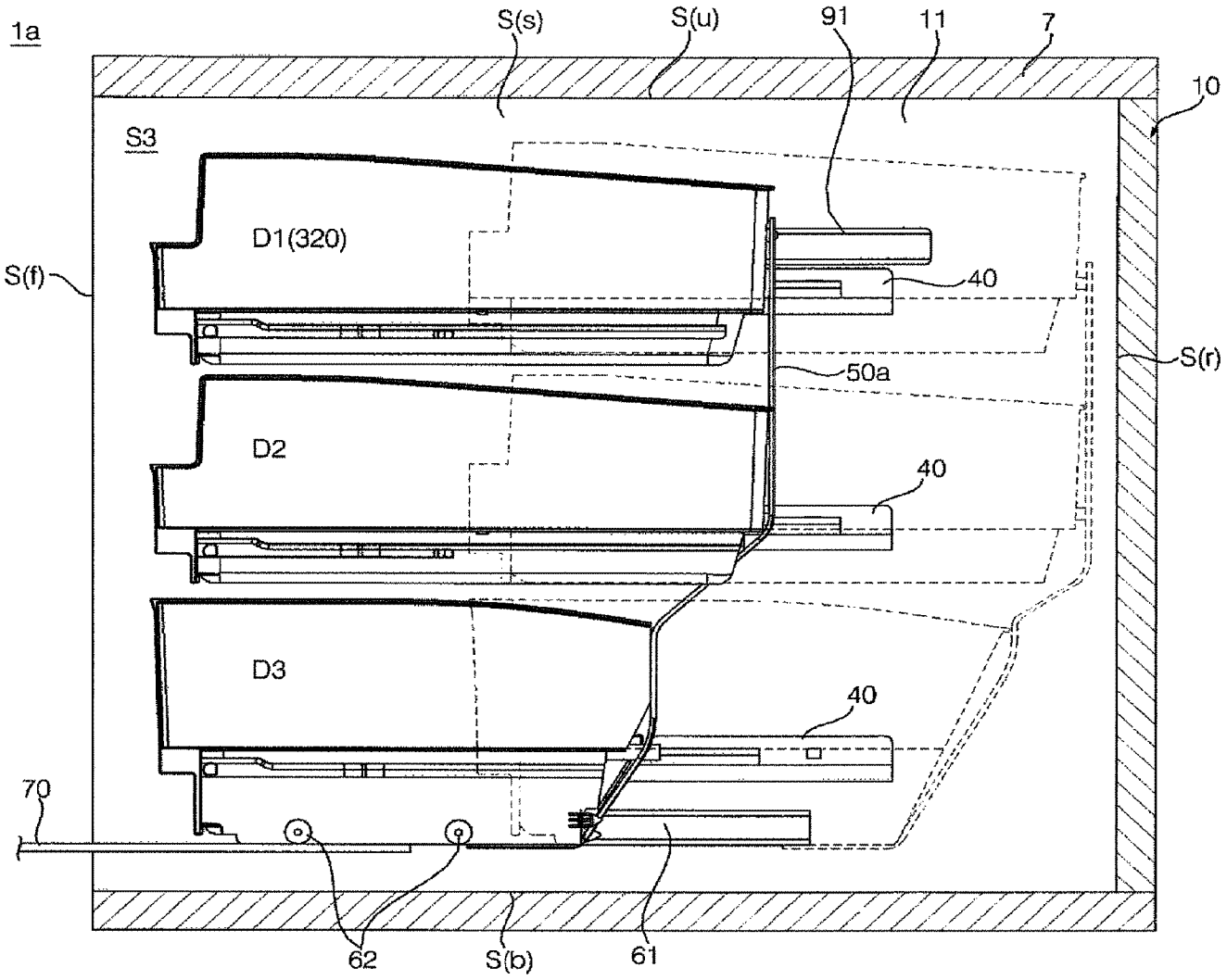

【FIG. 4】
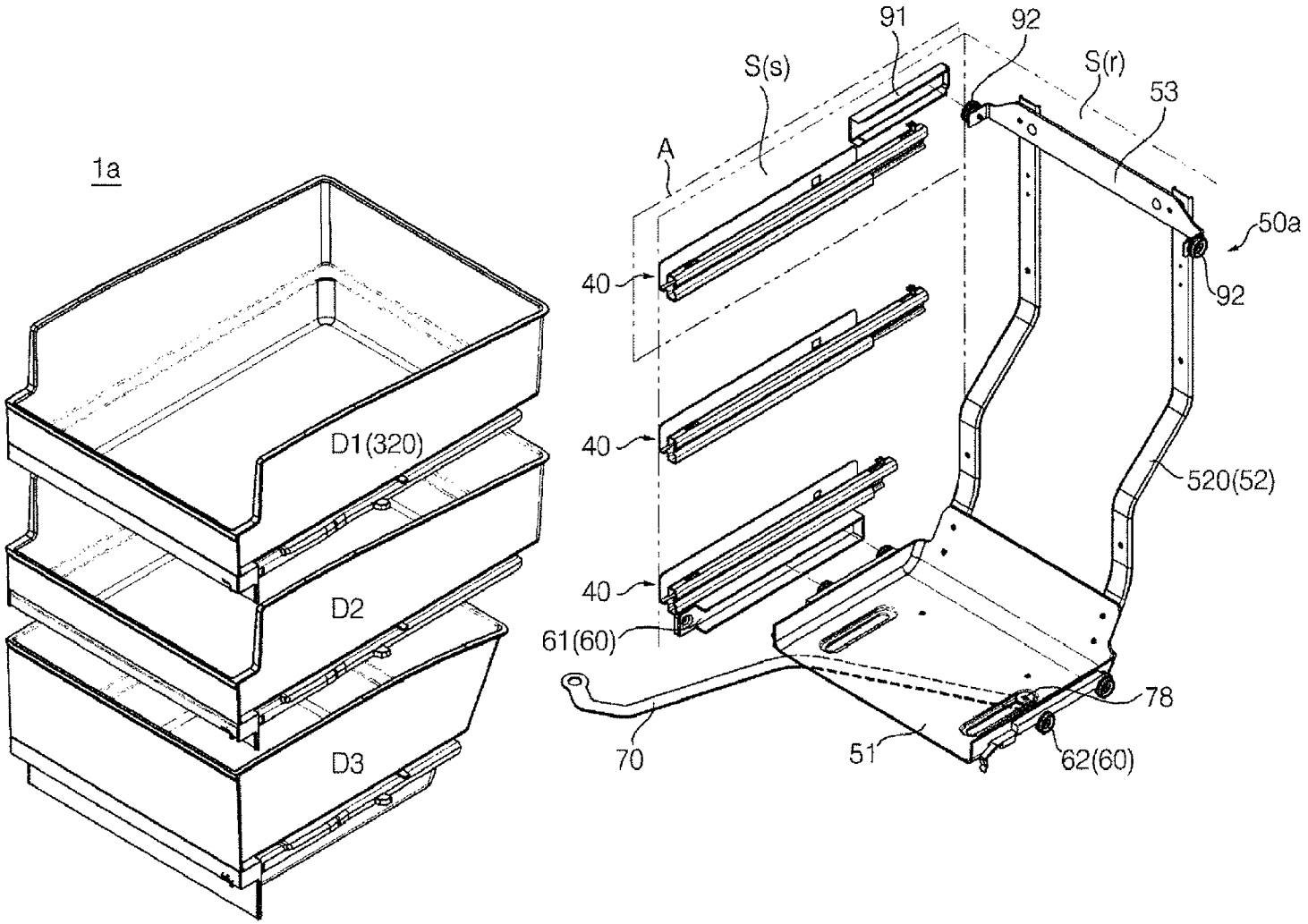

【FIG. 5】
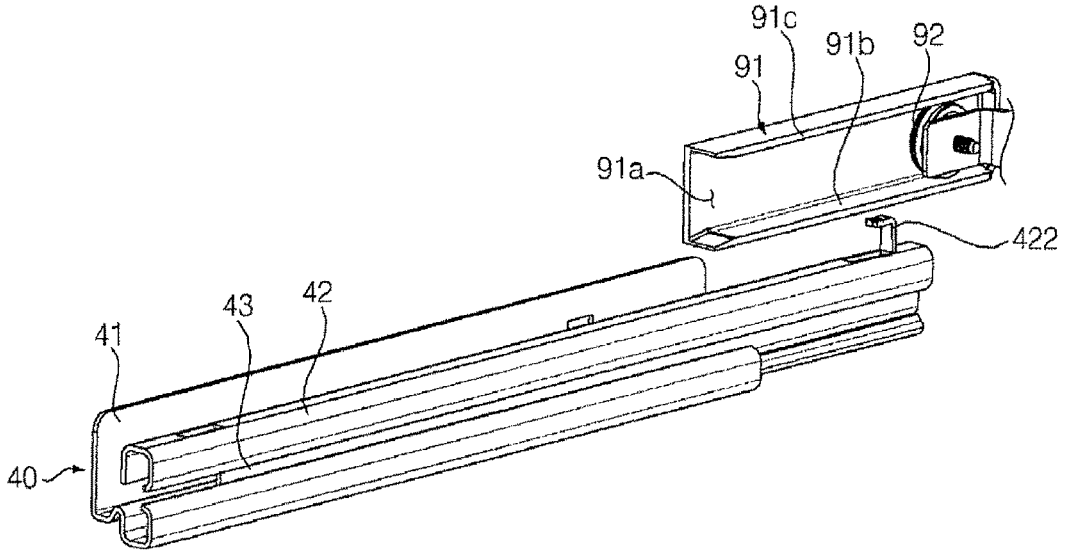
【FIG. 6】
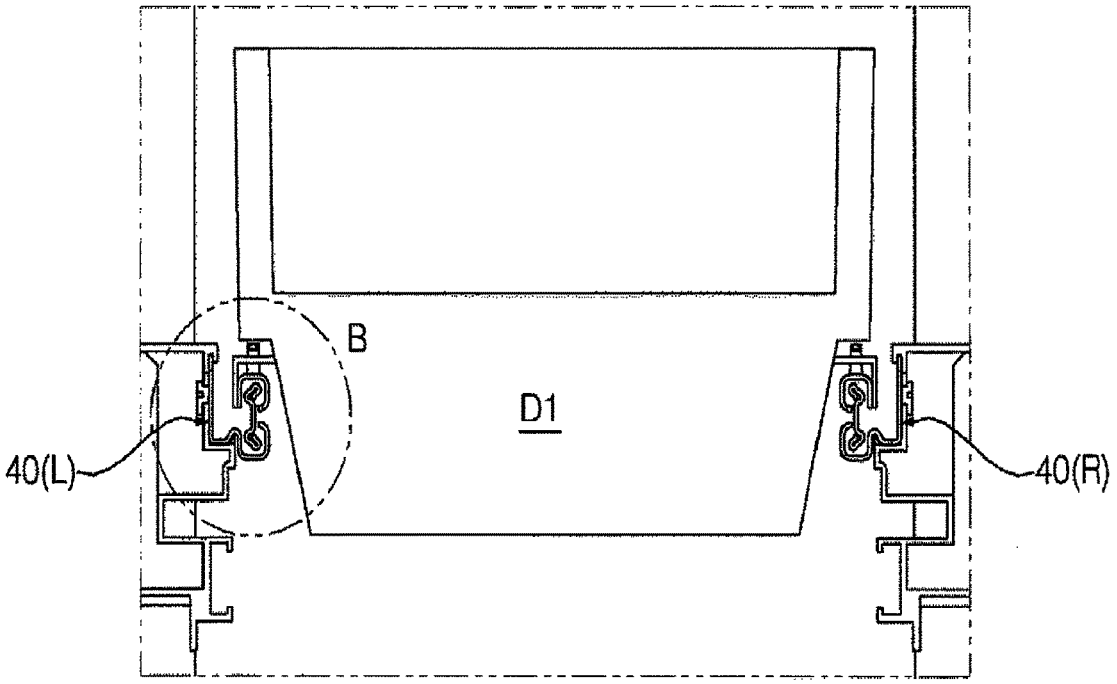

【FIG. 7】
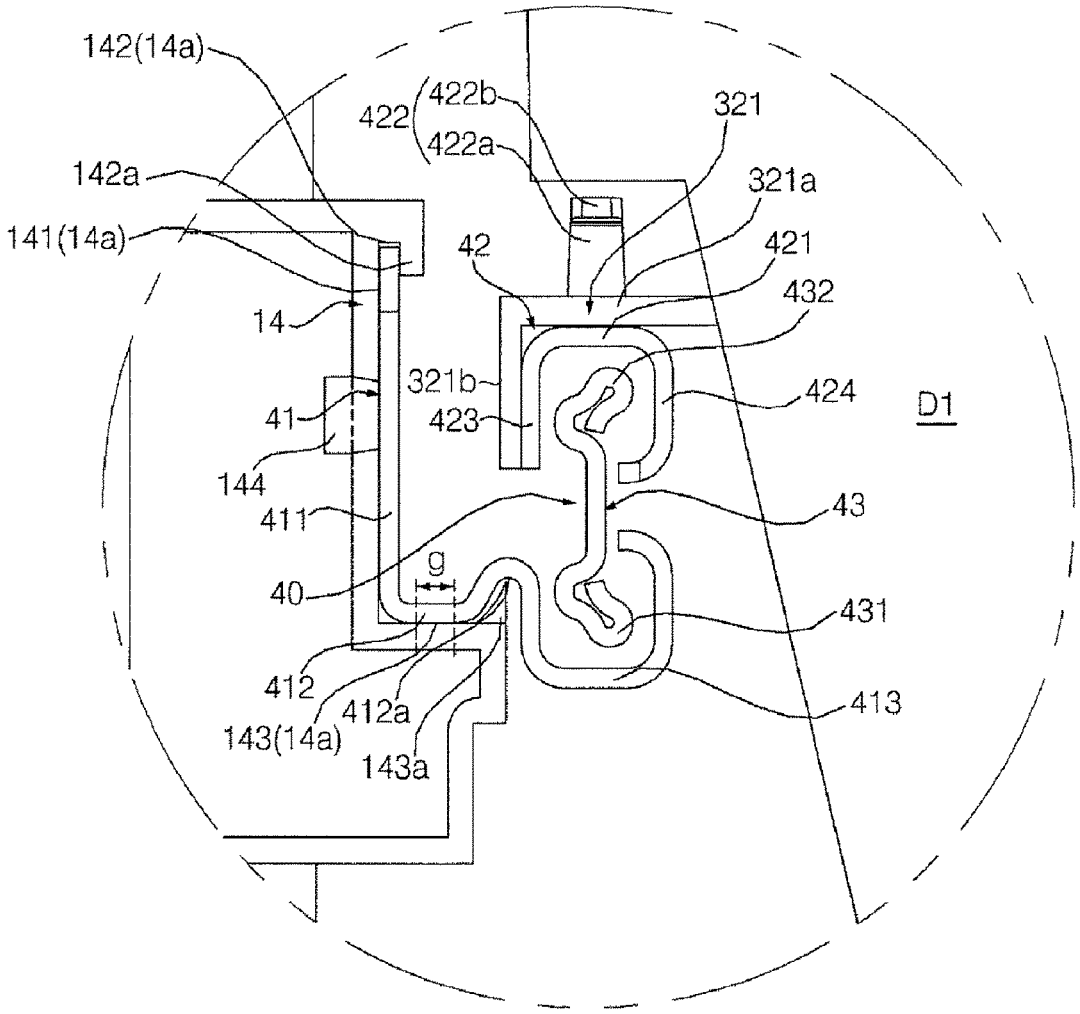

【FIG. 8】
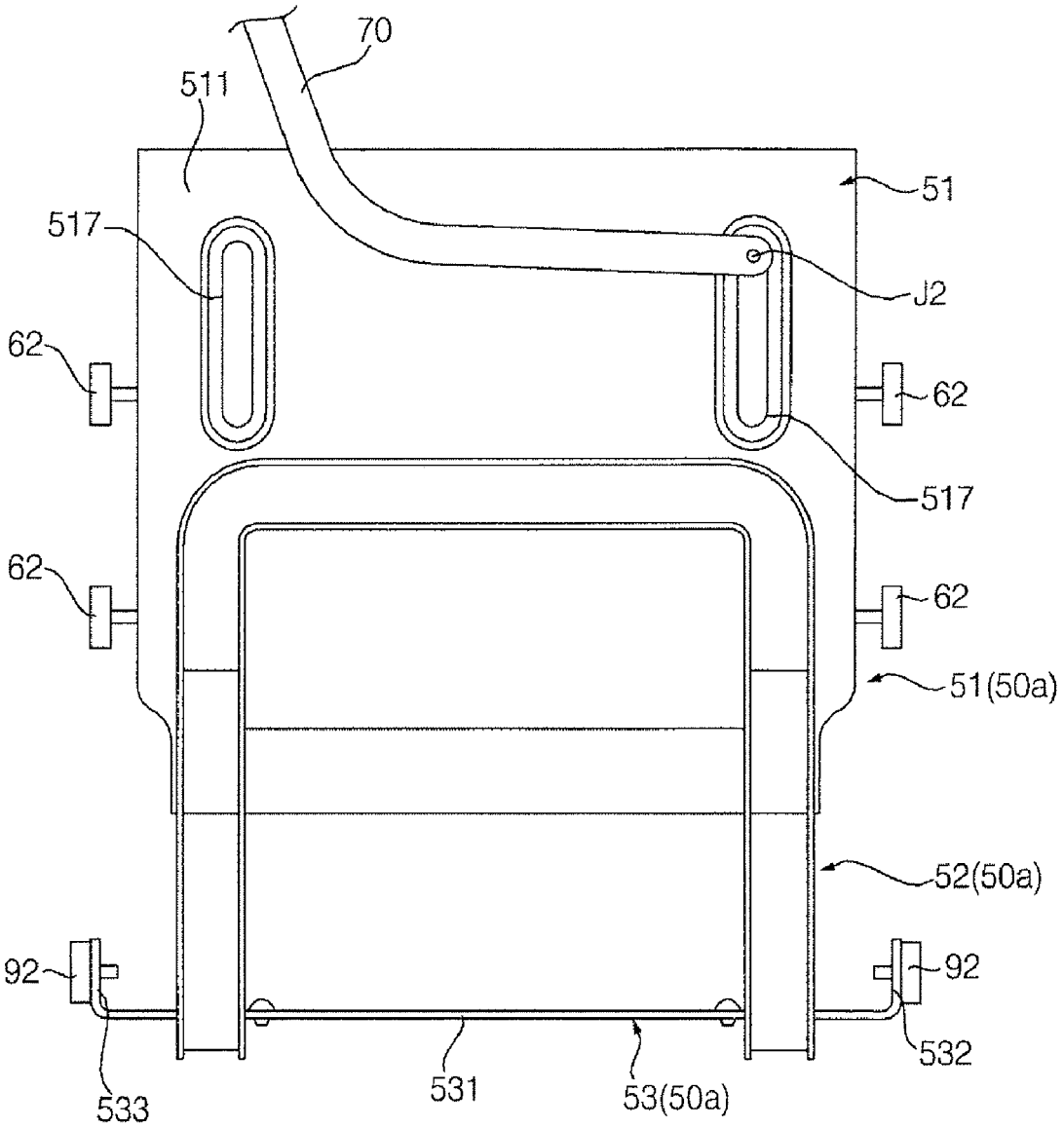

【FIG. 9a】
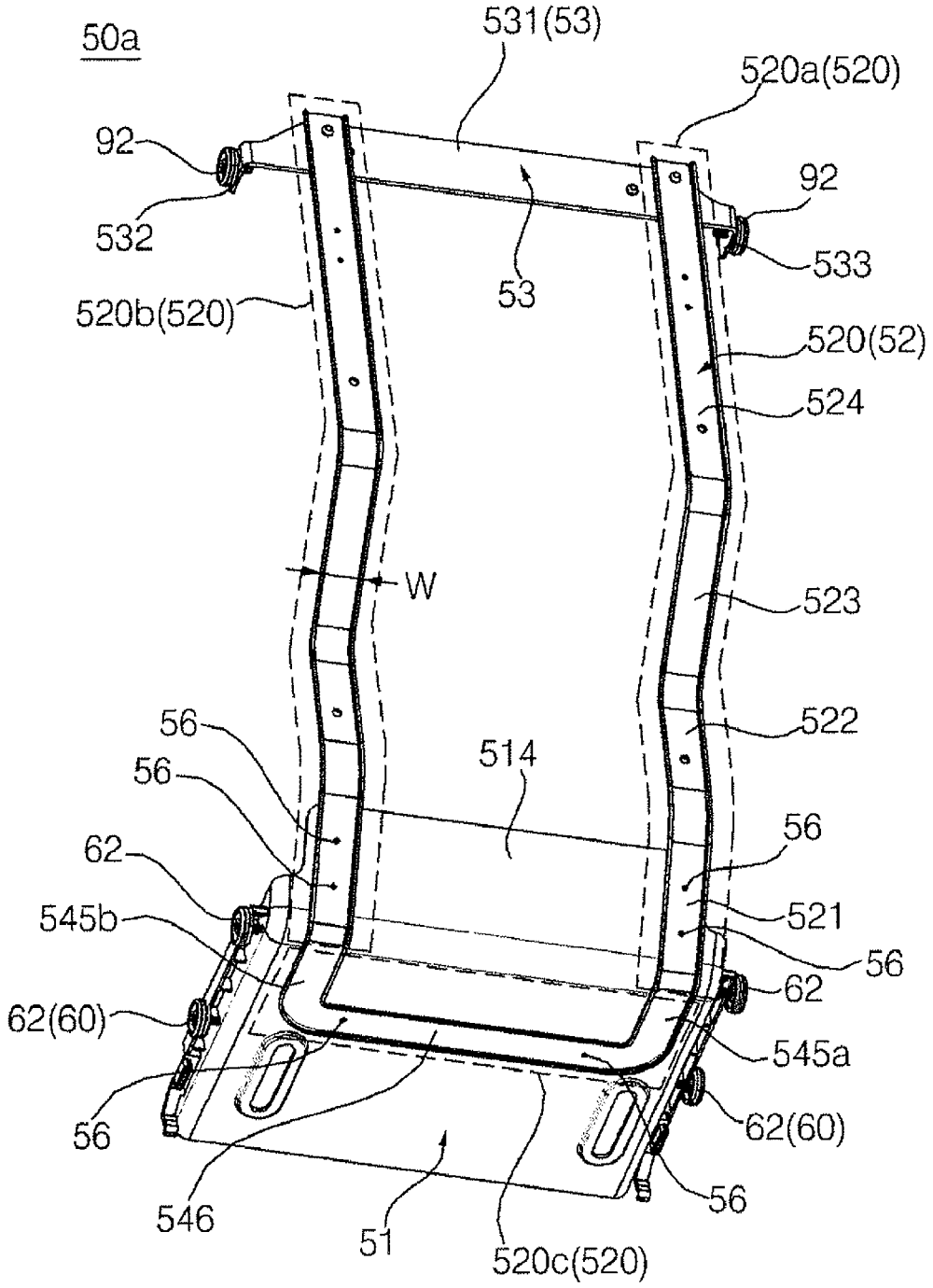

【FIG. 9b】
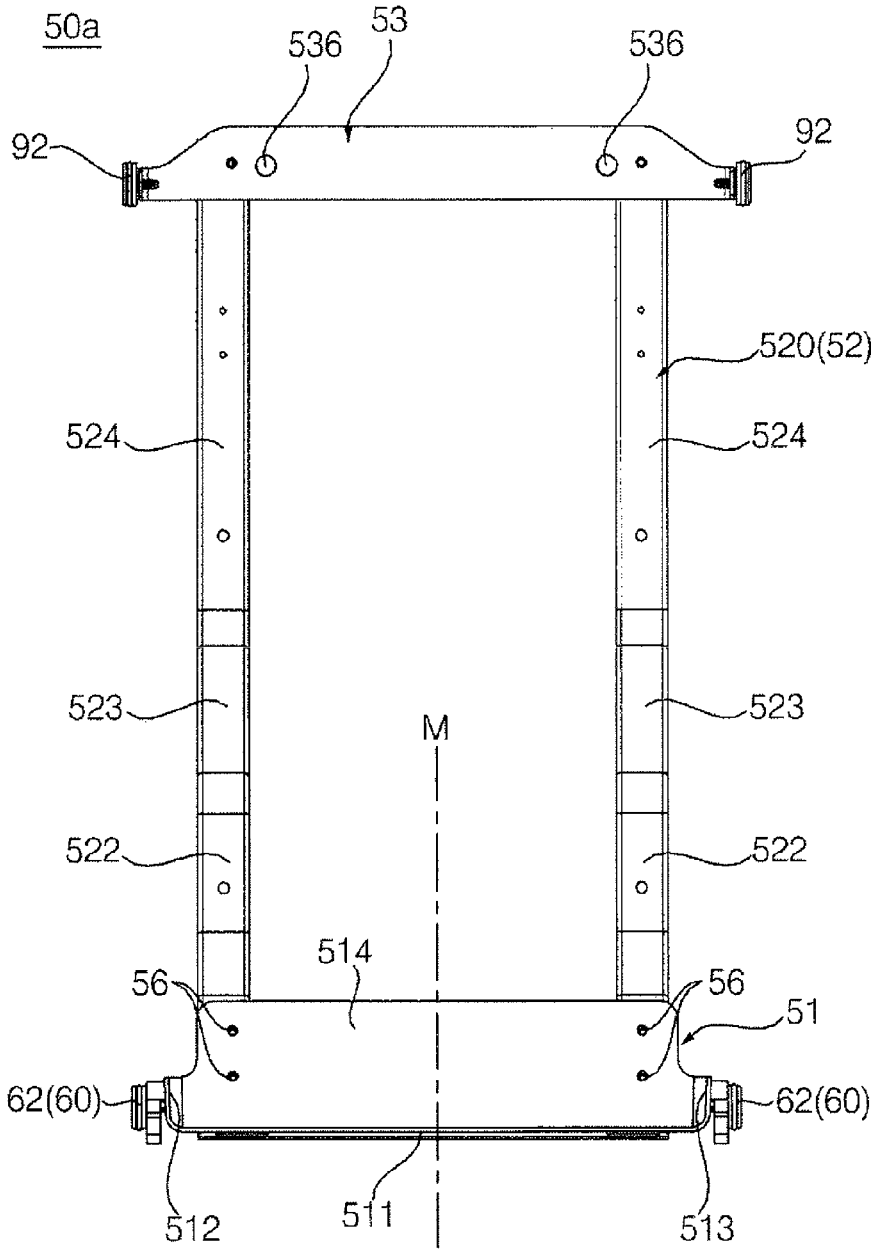

【FIG. 9c】
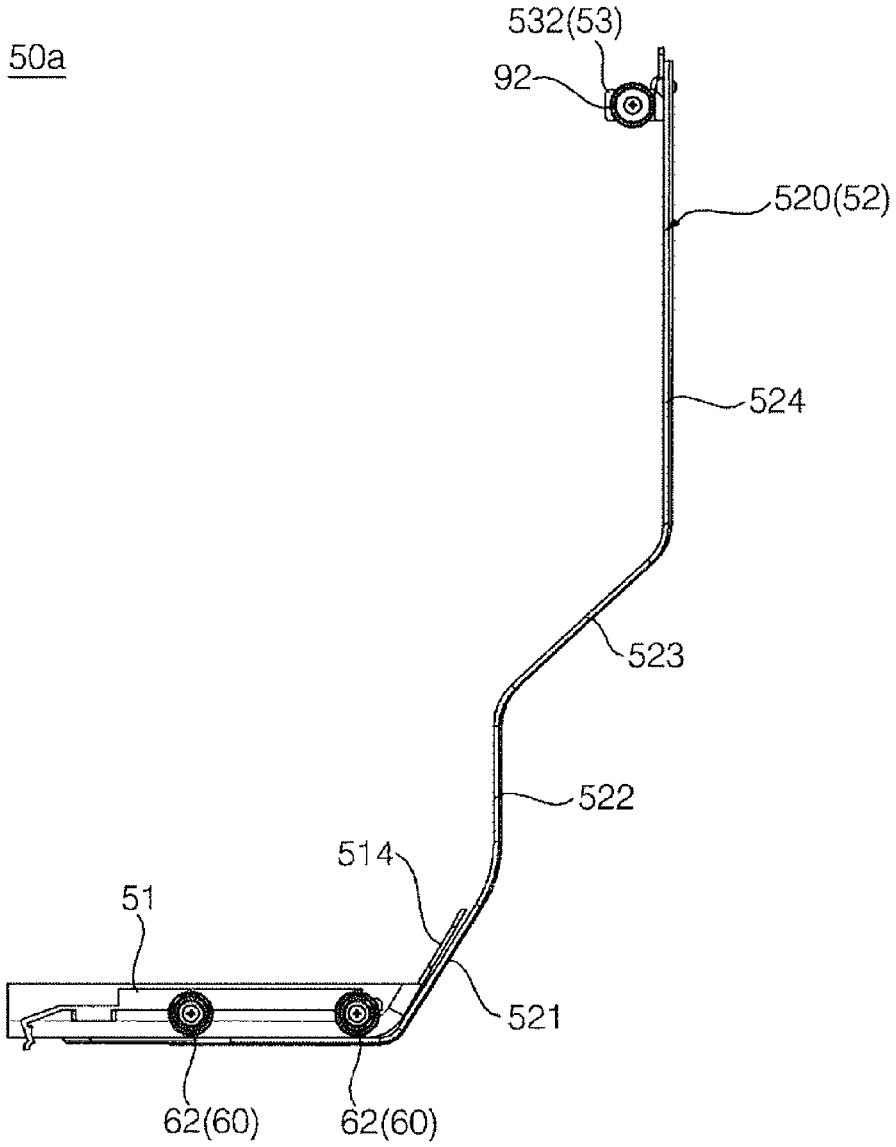

【FIG. 10a】
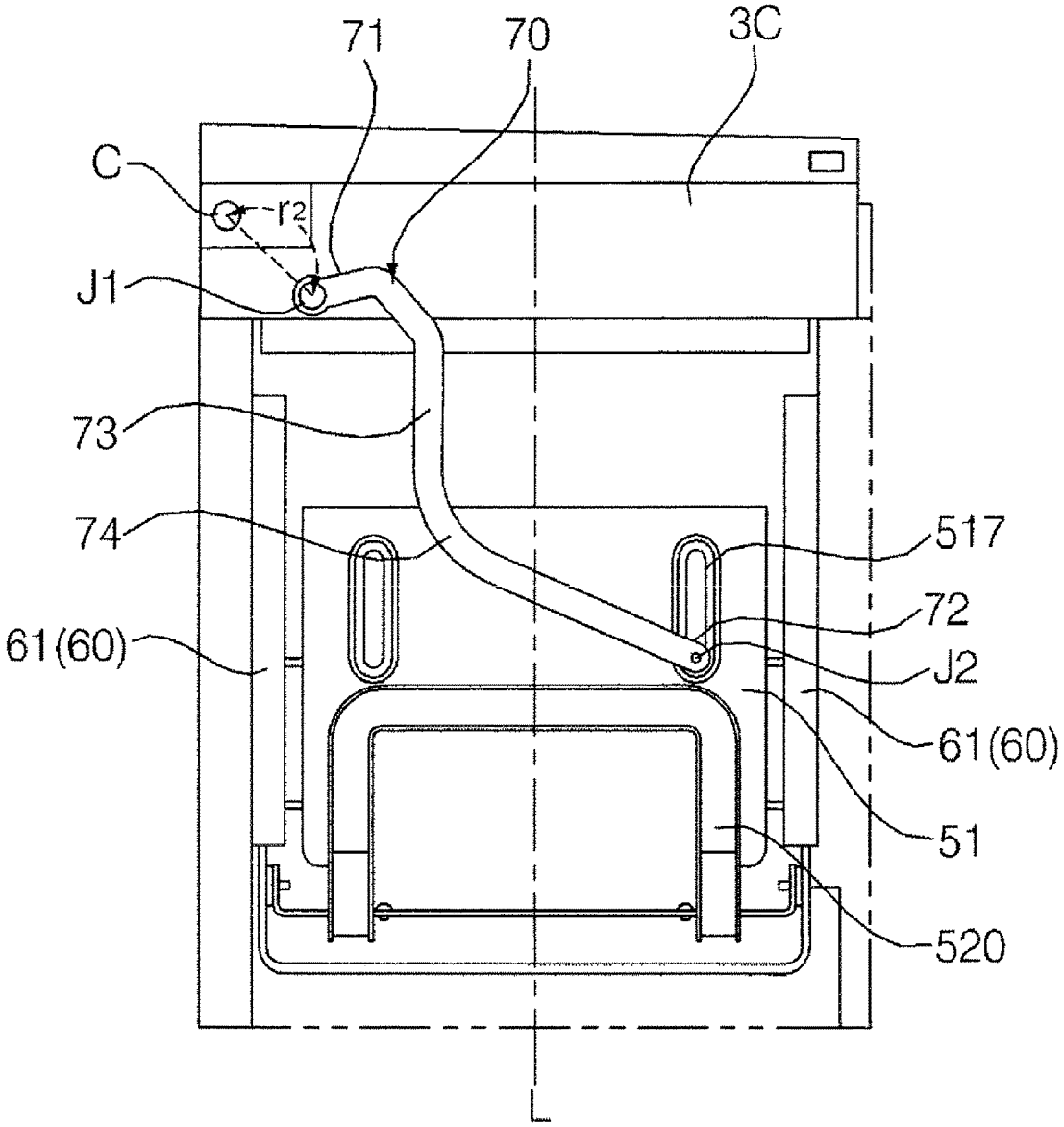

【FIG. 10b】
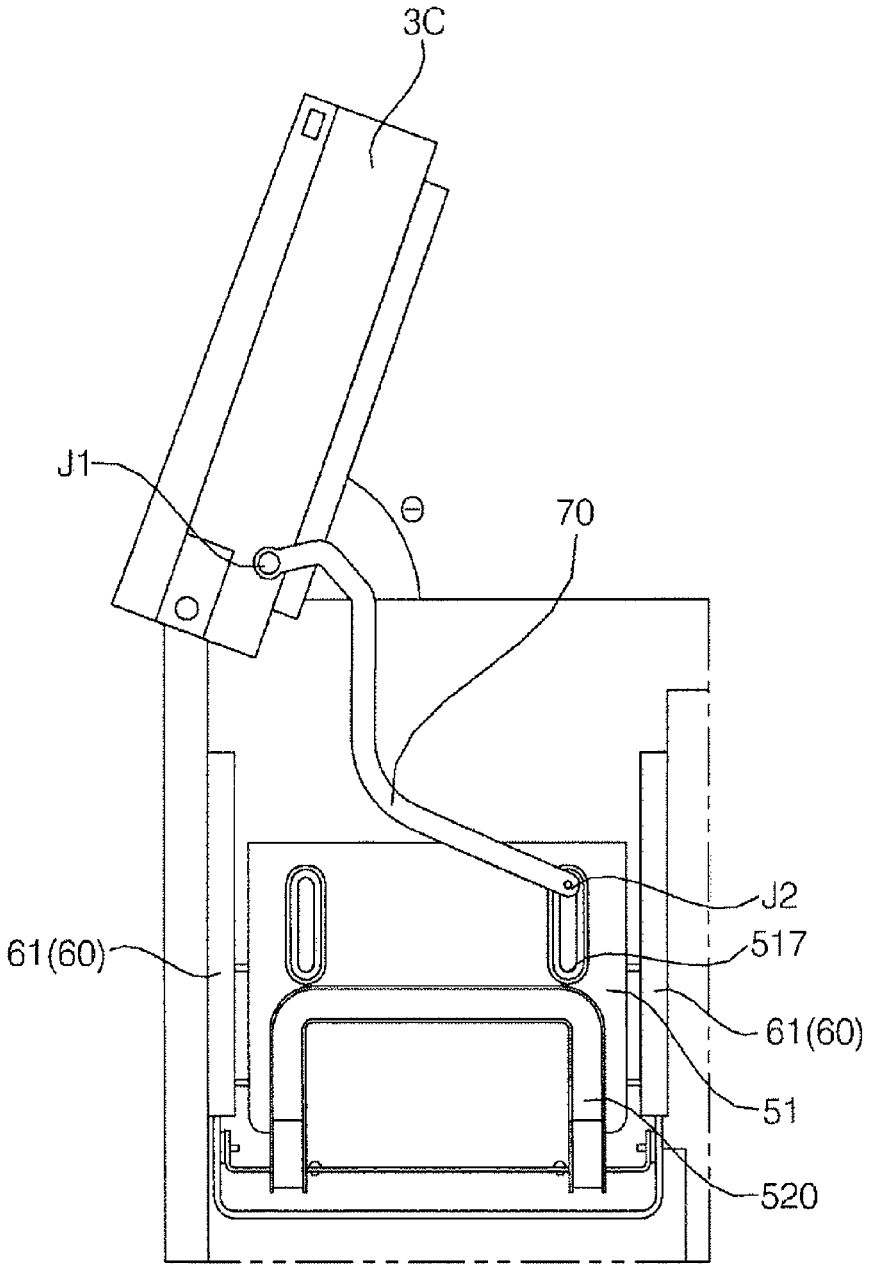

【FIG. 10c】
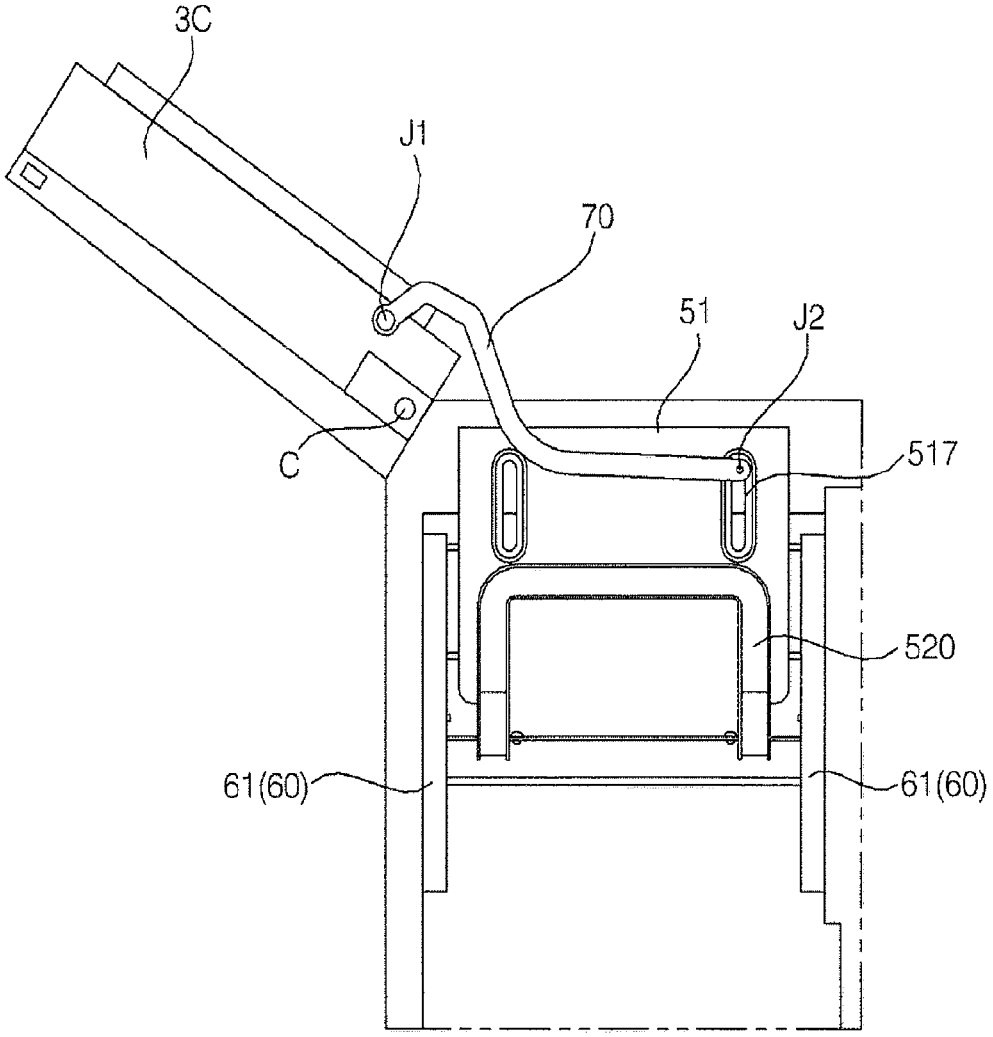

【FIG. 11】
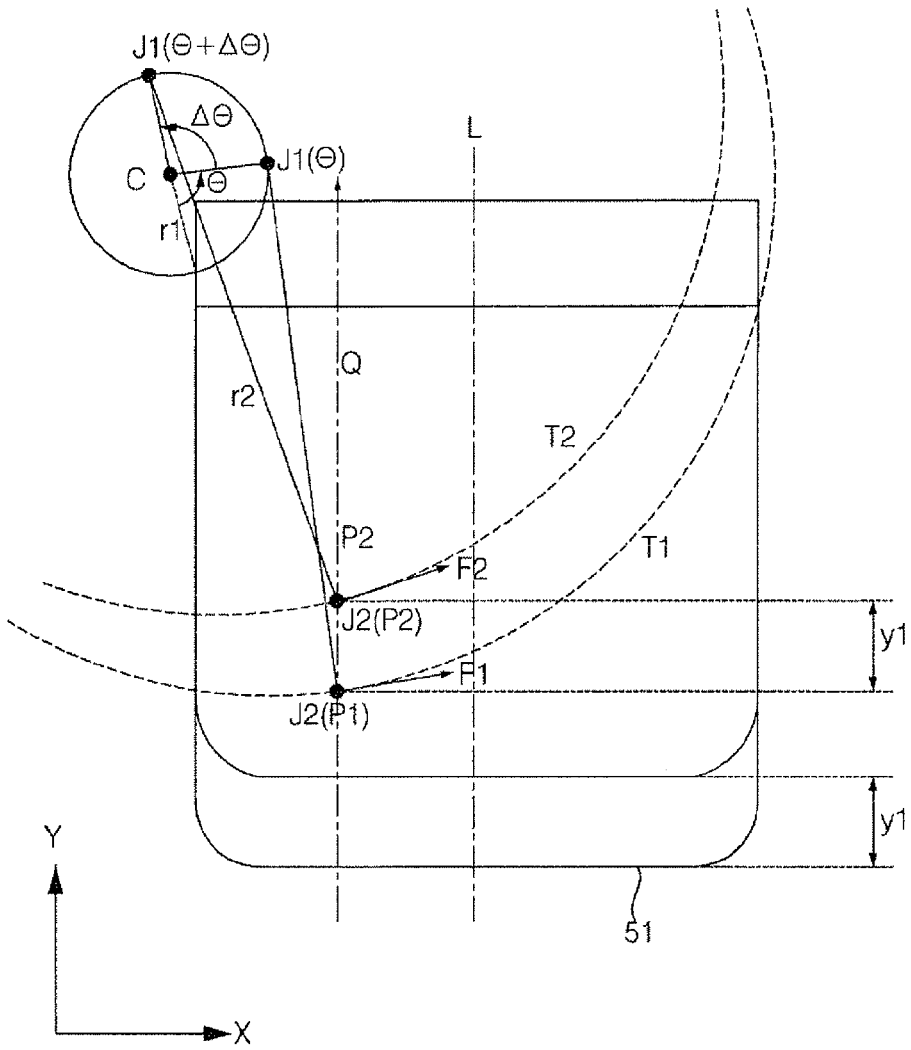

【FIG. 12】
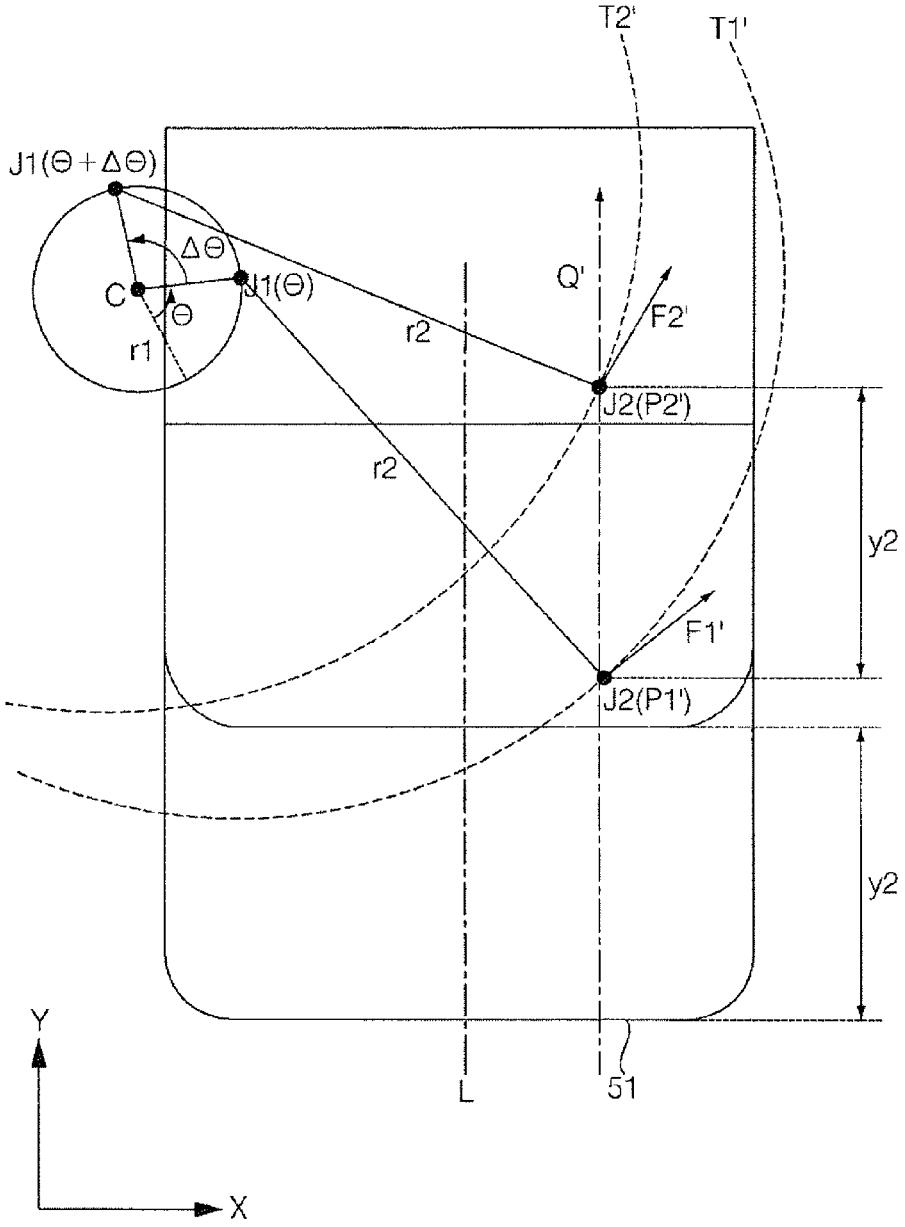

【FIG. 13】
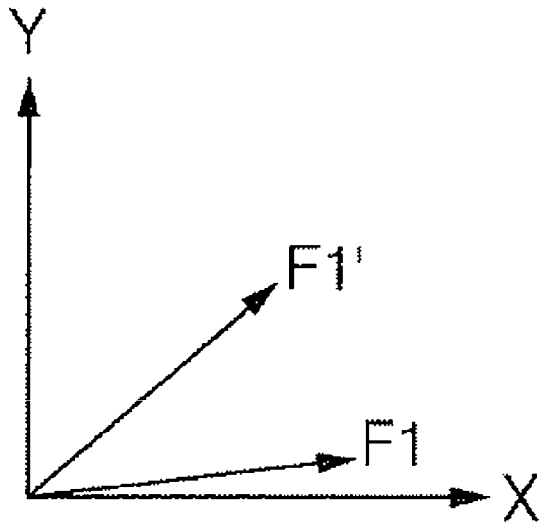

REFRIGERATOR

CROSS-REFERENCE TO RELATED APPLICATIONS

This application is a National Stage application under 35 U.S.C. § 371 of International Application No. PCT/KR2016/001454, filed Feb. 12, 2017, which claims the benefit of Korean Application No. 10-2016-0001269, filed on Jan. 5, 2016, Korean Application No. 10-2016-0001267, filed on Jan. 5, 2016, and Korean Application No. 10-2015-0022197, filed on Feb. 13, 2015. The disclosures of the prior applications are incorporated by reference in their entirety.

TECHNICAL FIELD

The present invention relates to a refrigerator.

BACKGROUND ART

A refrigerator is an electric home appliance that is used to store food in a refrigerated state or in a frozen state.

In recent years, the capacity of the refrigerator has been greatly increased, and a home bar, an ice maker, a shelf, or a door box has been mounted on the rear of a door of the refrigerator. In this type of refrigerator, when the door of the refrigerator is closed, the component mounted on the rear of the door of the refrigerator may interfere with a shelf or a drawer mounted in a storage compartment of a main body of the refrigerator.

In order to prevent such interference, the front end of a drawer (e.g. a shelf or a drawer) mounted in the storage compartment of the main body of the refrigerator (e.g. a refrigerating compartment or a freezing compartment) is located at a place spaced apart from the front of the main body of the refrigerator by a predetermined distance.

For this reason, a user must put his/her hand into the storage compartment deeply in order to take out food stored in the drawer. Furthermore, it is difficult for the user to check the food stored in the rear portion of the storage compartment. These problems become more critical as the size of the refrigerator is increased.

Various methods have been proposed to solve the above problems. For example, Korean Patent Application Publication No. 2010-0130357 (hereinafter, referred to as '357 patent) discloses a refrigerator configured to have a structure in which a shelf or a drawer mounted in a refrigerating compartment or a freezing compartment is disposed at a receiving frame, the front end of an articulated link is connected to the bottom surface of a refrigerator door, and the rear end of the articulated link is connected to the receiving frame. When the refrigerator door is turned and opened, therefore, the receiving frame is moved forward, with the result that the shelf or the drawer is moved forward.

The conventional refrigerator is configured to have a structure in which the rotational motion of the door is converted into the rectilinear motion of the receiving frame via a link. In this structure, only the forward moving component of the force applied to the receiving frame via the link contributes to the movement of the receiving frame. In '357 patent, the rear end of the link, which is connected to the receiving frame, and the front end of the link, which is connected to the door, are close to each other when the refrigerator is viewed from the front. In order to increase the forward moving component of the force applied to the receiving frame and to increase the displacement of the receiving frame with respect to the rotational angle of the door, therefore, it is necessary to provide an articulated link, with the result that the structure is complicated and manufacturing cost is increased.

DISCLOSURE

Technical Problem

An object of the present invention is to provide a refrigerator configured such that a withdrawal mechanism connected to a door via a rigid link (i.e. a single link) withdraws a drawer in response to the turning of the door and such that force for turning the door is effectively transmitted via the link so that the drawer may be easily withdrawn.

Another object of the present invention is to provide a refrigerator configured such that the forward moving component (i.e. the Y-axis component; see FIG. 12) of the force applied to the withdrawal mechanism via the link is increased, whereby the withdrawal mechanism is easily moved, and such that the horizontal component (i.e. the X-axis component), which does not contribute to the movement of the withdrawal mechanism, is reduced.

Another object of the present invention is to provide a refrigerator configured such that the withdrawal mechanism is not moved until the door reaches a withdrawal start angle in the state in which the door is closed and such that the withdrawal mechanism is moved forward a sufficient distance within a door turning section where the door is fully opened from the withdrawal start angle. In particular, another object of the present invention is to provide a refrigerator configured such that the withdrawal start angle is set to 70 to 80 degrees in order to secure a sufficient withdrawal delay section and such that the withdrawal mechanism is moved forward a sufficient distance even in the case in which a section where the door is fully opened from the withdrawal start angle is reduced.

Another object of the present invention is to provide a refrigerator wherein the shape of the link is improved in order to prevent interference between the link and the door during opening of the door.

A further object of the present invention is to provide a refrigerator configured such that, when a user opens the door, the user's force pulling the door is used only to open the door at the beginning of opening of the door (i.e. until the door is turned to the withdrawal start angle).

Technical Solution

A refrigerator according to an embodiment of the present invention may include a cabinet having a storage compartment therein, the storage compartment being provided in the front surface thereof with an opening, a door hinged to the cabinet for opening and closing at least a portion of the opening, a drawer disposed in the storage compartment for storing goods, a drawer guide for supporting the drawer and guiding the drawer so as to be movable in a forward-rearward direction, a withdrawal mechanism including a base part disposed at the lower side of the drawer and a rear frame extending from the base part toward the rear of the drawer for pushing the drawer forward when the base part is moved forward, a link having a front end connected to the door at a position spaced apart from a turning axis of the door with respect to the cabinet by a predetermined distance so as to constitute a first turning joint and a rear end connected to the base part so as to constitute a second turning joint, and a pair of withdrawal mechanism guides disposed so as to be spaced apart from each other in the width direction of the storage compartment for guiding the base part so as to be movable in the forward-rearward direction, wherein the first turning joint and the second turning joint may be opposite each other about a reference line located equidistant from the withdrawal mechanism guides.

The second turning joint may be closer to the withdrawal mechanism guides than to the reference line.

The second turning joint may be configured to be allowed to move relative to the base part in the forward-rearward direction. The base part may include a slit extending between the reference line and the withdrawal mechanism guides in the forward-rearward direction, and the rear end of the link may be configured to be movable along the slit. The rear end of the link may be spaced apart from the front end of the slit in the state in which the door is closed, and may reach the front end of the slit when the door is turned to a predetermined withdrawal start angle in the state in which the door is closed. The withdrawal start angle may be 70 to 80 degrees.

The link may include a first bent section extending from the front end and bent convexly in a direction away from the turning axis of the door with respect to the cabinet and a second bent section located between the first bent section and the rear end and bent convexly in a direction opposite the first bent section. The first bent section and the second bent section may be convex in opposite directions with respect to a straight line connecting the front end and the rear end.

The distance between the first turning joint and the second turning joint may be longer than the distance between the cabinet and the turning axis of the door.

The withdrawal mechanism guides may be disposed between the base part and side surfaces of the storage compartment.

The rear end of the link may be connected to the bottom surface of the base part.

Advantageous Effects

A refrigerator according to an embodiment of the present invention with the above-stated construction has the following effects.

First, the forward moving component (i.e. the Y-axis component) of the force applied to the withdrawal mechanism via the link is sufficiently secured, whereby the withdrawal mechanism is easily moved. In addition, the horizontal component (i.e. the X-axis component), which does not contribute to the movement of the withdrawal mechanism, is reduced.

Second, the turning range of the door corresponding to the section in which the withdrawal of the drawer is delayed is sufficiently secured while the delayed withdrawal of the drawer is achieved. When the drawer is withdrawn by the withdrawal mechanism, therefore, the movement distance of the withdrawal mechanism when the door is turned is increased while the possibility of collision between the drawer and the door is assuredly eliminated.

Third, interference between the door and the link is prevented during opening of the door.

DESCRIPTION OF DRAWINGS

FIG. 1 is a perspective view showing a refrigerator according to an embodiment of the present invention;

FIG. 2 is a view showing the state in which doors of the refrigerator of FIG. 1 are open;

FIG. 3 is a side view showing the interior of a storage compartment of the refrigerator according to the embodiment of the present invention;

FIG. 4 is an exploded perspective view showing main parts constituting the refrigerator of FIG. 3;

FIG. 5 is an enlarged view showing part A of FIG. 4;

FIG. 6 is a view showing an assembly of drawers and drawer guides when viewed from the front;

FIG. 7 is an enlarged view showing part B of FIG. 6;

FIG. 8 is a view showing an assembly of a withdrawal mechanism and a link when viewed from below;

FIG. 9*a* is a view of the withdrawal mechanism when viewed from the rear and from below;

FIG. 9*b* is a front view of the withdrawal mechanism;

FIG. 9*c* is a right side view of the withdrawal mechanism;

FIG. 10*a* is a view showing the bottom surface of a base part exposed in the state in which a door is closed;

FIG. 10*b* is a view showing the state in which the door of FIG. 10*a* is open to a withdrawal start angle;

FIG. 10*c* is a view showing the state in which the door of FIG. 10*b* is fully open;

FIG. 11 is a view showing the positions of a first turning joint and a second turning joint during opening of the door in a comparative example;

FIG. 12 is a view showing the positions of a first turning joint and a second turning joint during opening of the door in the refrigerator according to the embodiment of the present invention; and FIG. 13 is a view showing forces shown in FIGS. 11 and 12 on a coordinate system.

BEST MODE

The advantages and features of the present invention and methods for achieving them will be more clearly understood from the following detailed description taken in conjunction with the accompanying drawings. However, the present invention may be embodied in many different forms and should not be construed as limited to the embodiments set forth herein. Rather, these embodiments are provided so that the present invention will be thorough and complete, and will fully convey the scope of the invention to those skilled in the art. The present invention is defined only by the categories of the claims. Wherever possible, the same reference symbols will be used throughout the drawings to refer to the same or like parts.

FIG. 1 is a perspective view showing a refrigerator 1*a* according to an embodiment of the present invention. FIG. 2 is a view showing the state in which doors 3*a*, 3*b*, 3*c*, and 3*d* of the refrigerator 1*a* of FIG. 1 are open. FIG. 3 is a side view showing the interior of a storage compartment S3 of the refrigerator 1*a* according to the embodiment of the present invention. The "forward"/"rearward"/"leftward"/"rightward"/"upward"/"downward" directions set forth herein are defined as shown in FIG. 1. However, these directions are used merely to clearly describe the present invention. Consequently, the above directions may be differently defined as needed.

Referring to FIGS. 1 and 2, a refrigerator 1*a* may include a cabinet 10 having compartments RC and FC (or storage compartments S1, S2, S3, and S4) defined therein and doors 3*a*, 3*b*, 3*c*, and 3*d* for opening and closing the compartments RC and FC. The doors 3*a*, 3*b*, 3*c*, and 3*d* may be hinged to the cabinet 10.

The front surfaces of the compartments RC and FC are open such that food is introduced and removed through the front surfaces of the compartments RC and FC. The open front surfaces of the compartments RC and FC may be opened and closed by the doors 3*a*, 3*b*, 3*c*, and 3*d*. Cool air is supplied into the compartments RC and FC. The compartments RC and FC may be sealed by the doors 3*a*, 3*b*, 3*c*, and 3*d* such that cool air does not leak from the compartments RC and FC.

Two or more compartments RC and FC may be provided. For a bottom freezer type refrigerator as in this embodiment, the cabinet 10 is partitioned into the upper part and the lower part, and the compartments RC and FC are provided in the upper part and the lower part of the cabinet 10, respectively. In this case, the lower compartment FC is a freezing compartment, the interior temperature of which is maintained below 0° C., and the upper compartment RC is a refrigerating compartment, the interior temperature of which is maintained above 0° C. In the following description, a "compartment" may be a refrigerating compartment or a freezing compartment, unless mentioned otherwise.

Each of the partitions RC and FC may be opened and closed by a pair of doors. For example, as in this embodiment, the refrigerating compartment RC may be opened and closed by a pair of refrigerating compartment doors 3*a* and 3*b*, and the freezing compartment FC may be opened and closed by a pair of freezing compartment doors 3*c* and 3*d*.

The storage compartments S1, S2, S3, and S4 constitute all or portions of the partitions RC and FC. The storage compartments S1, S2, S3, and S4 may be defined as regions that are opened and closed by the doors 3*a*, 3*b*, 3*c*, and 3*d*. The refrigerating compartment RC may include a storage compartment S1, the open front surface of which is opened and closed by a left refrigerating compartment door 3*a*, and a storage compartment S2, the open front surface of which is opened and closed by a right refrigerating compartment door 3*b*. Hereinafter, the storage compartment S1 may be referred to as a left refrigerating storage compartment and the storage compartment S2 may be referred to as a right refrigerating storage compartment as needed.

In the same manner, the freezing compartment FC may include a storage compartment S3, the open front surface of which is opened and closed by a left freezing compartment door 3*c*, and a storage compartment S4, the open front surface of which is opened and closed by a right freezing compartment door 3*d*. Hereinafter, the storage compartment S3 may be referred to as a left freezing storage compartment and the storage compartment S4 may be referred to as a right freezing storage compartment as needed.

In the case in which two storage compartments are provided in one compartment in the horizontal direction, as described above, the storage compartments may communicate with each other. For example, when the refrigerating compartment RC is viewed from the front, the left refrigerating storage compartment S1 and the right refrigerating storage compartment S2 are not divided from each other. Consequently, cool air may freely flow between the left refrigerating storage compartment S1 and the right refrigerating storage compartment S2.

In this embodiment, a vertical partition 20 is provided between the left freezing storage compartment S3 and the right freezing storage compartment S4 of the freezing compartment FC, unlike the refrigerating compartment RC. As a result, the storage compartments S3 and S4 are partitioned from each other. Even in this case, however, the flow of cool air between the storage compartments S3 and S4 may not be completely blocked. For example, the vertical partition 20 may be provided with through holes (not shown), through which the storage compartments S3 and S4 communicate with each other.

Referring to FIG. 3, each of the storage compartments S1, S2, S3, and S4 may be defined by a front surface S(f) having an opening therein, a pair of side surfaces S(s) extending rearward from the front surface S(f) while facing each other, an upper surface S(u) interconnecting the upper ends of the side surfaces S(s), a bottom surface S(b) or a bottom interconnecting the lower ends of the side surfaces S(s) while facing the upper surface S(u), and a rear surface S(r) interconnecting the side surfaces S(s), the upper surface S(u), and the bottom surface S(b) while facing the opening.

According to the above definition, in the case in which one space is partitioned into two parts by the vertical partition 20 to form two storage compartments S3 and S4 in the horizontal direction, as in the freezing compartment FC, the bottom surface S(b) and the rear surface S® of each of the storage compartments S3 and S4 may be defined by the inner surface of the cabinet 10. The upper surface S(u) of each of the storage compartments S3 and S4 may be defined by the bottom surface of the horizontal partition 7, which partitions the refrigerating compartment RC and the freezing compartment FC from each other. One of the side surfaces of each of the storage compartments S3 and S4 may be defined by an inner surface 11 of the cabinet 10. The other side surface of each of the storage compartments S3 and S4 may be defined by one surface of the vertical partition 20 that faces the inner surface 11 of the cabinet 10.

Of course, in other embodiments, in the case in which the refrigerating compartment RC is partitioned into a pair of storage compartments by the vertical partition, one side surface, the upper surface, and the rear surface of each of the storage compartments S1 and S2 constituting the refrigerating compartment RC may be defined by the inner surface of the cabinet 10, the bottom surface of each of the storage compartments S1 and S2 may be defined by the upper surface of the horizontal partition 7, and the other side surface of each of the storage compartments S1 and S2 may be defined by one surface of the vertical partition that faces the one side surface.

The doors 3*a*, 3*b*, 3*c*, and 3*d* may be provided so as to correspond to the storage compartments S1, S2, S3, and S4. A door storage unit for storing food may be formed in the rear parts of the doors 3*a*, 3*b*, 3*c*, and 3*d*, i.e. the parts of the doors 3*a*, 3*b*, 3*c*, and 3*d* that face the open front surfaces of the storage compartments S1, S2, S3, and S4. The door storage unit may include storage chambers 8*a* for storing food that is frequently taken out of the refrigerator, such as dairy products, beverages, vegetables, etc, a tray 8*b* for storing ice, and baskets 8*c* for storing small-sized frozen food. In the state in which the doors 3*a*, 3*b*, 3*c*, and 3*d* are closed, at least a portion of the door storage unit 8*a*, 8*b*, and 8*c* may be located in the storage compartments S1, S2, S3, and S4.

A drawer D may be disposed in the compartments RC and FC or the storage compartments S1, S2, S3, and S4. The drawer D is provided to store or hold food. A plurality of drawers may be arranged in the upward-downward direction. Each drawer D may be constituted by a container (or a bin) 320 having a predetermined-sized space for storing food. Alternatively, each drawer D may be constituted by a horizontal plate-shaped shelf 310.

FIG. 3 is a side view showing the interior of the storage compartment S3 of the refrigerator 1*a* according to the embodiment of the present invention. FIG. 4 is an exploded perspective view showing main parts constituting the refrigerator 1*a* of FIG. 3. FIG. 5 is an enlarged view showing part A of FIG. 4. FIG. 6 is a view showing an assembly of drawers D1, D2, and D3 and drawer guides 40*a* when viewed from the front. FIG. 7 is an enlarged view showing part B of FIG. 6. FIG. 8 is a view showing an assembly of a withdrawal mechanism 50*a* and a link 70 when viewed from below. FIG. 9*a* is a view of the withdrawal mechanism 50*a* when viewed from the rear and from below. FIG. 9*b* is a front view of the withdrawal mechanism 50*a*. FIG. 9*c* is a right side view of the withdrawal mechanism 50*a*. FIG. 10*a* is a view showing the bottom surface of a base part 51 exposed in the state in which the door 3*c* is closed. FIG. 10*b* is a view showing the state in which the door 3*c* of FIG. 10*a* is open to a withdrawal start angle. FIG. 10*c* is a view showing the state in which the door 3*c* of FIG. 10*b* is fully open.

Hereinafter, the left freezing storage compartment S3 will be described by way of example with reference to the drawings. The structure of the left freezing storage compartment S3, which will be described below, may be applied to the other storage compartments S1, S2, and S4. In addition, the structure of the left freezing storage compartment S3 may also be applied to compartments of other embodiments, a description of which will follow.

The refrigerator 1*a* may include a cabinet 10, a door 3*c*, drawers D1, D2, and D3, drawer guides 40*a*, a withdrawal mechanism 50*a*, a withdrawal mechanism guide 60*a*, and a link 70.

Referring to FIG. 4, the drawer guides 40*a* may be disposed in the storage compartment S3 to support the drawers D. The drawer guides 40*a* guide the drawers D such that the drawers D can be moved in the forward-rearward direction. A pair of drawer guides 40*a* may be provided at opposite sides of one drawer (e.g. the drawer D1) to support the load of the drawer D1. In this embodiment, three drawer guides 40*a* are disposed at one side surface S(s) of the storage compartment S3 so as to correspond to three drawers D1, D2, and D3. Although not shown in FIG. 4, three drawer guides 40*a* are also disposed at the other side surface S(s) of the storage compartment S3.

A pair of drawer guides 40*a*, provided for each drawer D, may include a first drawer guide 40*a*(L) disposed at the inner surface 11 of the cabinet 10, which defines one side surface S(s) of the storage compartment S3, and a second drawer guide 40*a*(R) disposed at the other side surface S(s) (e.g. one surface of the vertical partition 20) of the storage compartment S3 (see FIG. 6).

The drawers D are supported by the drawer guides 40*a* in a state of static mechanical equilibrium. That is, the entire load of each drawer D is supported by the drawer guides 40*a*. Each drawer D remains stationary on the drawer guides 40*a* unless external force is applied to the drawer D. The entire load of each drawer D is substantially supported by the drawer guides 40*a*. A rear frame 52, a description of which will follow, is a non-load bearing element, which does not support the load of the drawers D.

Each drawer guide 40*a* may be formed to have various shapes, including that of a rail or a roller. For example, referring to FIGS. 6 and 7, each drawer guide 40*a* may include a stationary rail 41 fixed to the inner surface S(s) of the storage compartment S3 and extending in the forward-rearward direction and moving rails 42 and 43 configured to move along the stationary rail 41 such that the moving rails 42 and 43 move together with a corresponding one of the drawers D. A single moving rail may be provided, or two moving rails 42 and 43 may be provided as in this embodiment. The first moving rail 42 is coupled to a corresponding one of the drawers D in the state of being engaged with the second moving rail 43. The second moving rail 43 is engaged with the stationary rail 41.

When each drawer D is moved forward a predetermined distance from the original position (i.e. the position in the state in which the door 3*c* is closed), the first moving rail 42 moves along the second moving rail 43. When the first moving rail 42 moves forward further than the predetermined distance, the second moving rail 43 may move along the stationary rail 41. However, the structure of each drawer guide is not limited thereto. For example, each of the drawer guides may include a stationary rail fixed to the inner surface S(s) of the storage compartment S3 and a moving rail rotatably provided at a corresponding one of the drawers D so as to roll along the stationary rail during the movement of the drawer D.

Referring to FIG. 7, the stationary rail 41 is formed by bending a metal sheet several times. The stationary rail 41 may include a first strip part 411 extending in the forward-rearward direction in the state of being parallel to the side surface S(s) of the storage compartment S3, a second strip part 412 horizontally extending from the lower end of the first strip part 411 toward the drawer D1, and a pocket part 413 formed at one end of the second strip part 412 such that the lower end 431 of the second moving rail 43 is inserted into the pocket part 413.

The pocket part 413 has a "U"-shaped pocket having an inlet formed in the upper side thereof. The lower end 431 of the second moving rail 43 may be inserted into the pocket through the inlet in the pocket. The first moving rail 42 may have a section corresponding to the section of the pocket part 413. The first moving rail 42 has an inverse "U"-shaped pocket having an inlet formed in the lower side thereof. The upper end 432 of the second moving rail 43 may be inserted into the pocket through the inlet in the pocket.

A hook 422 may protrude upward from the first moving rail 42. A drawer connection member 321 for connecting the drawer D1 to the first moving rail 42 may be provided such that the drawer D1 can be supported by the drawer guide 40*a*. In this embodiment, the drawer connection member 321 is integrally formed with the drawer D1. However, the present invention is not limited thereto. The drawer connection member 321 may be formed as a separate part, and may then be coupled to the drawer D1.

The drawer connection member 321 may include a horizontal rib 321*a* coupled to the hook 422 of the first moving rail 42. The horizontal rib 321*a* may horizontally protrude from the outer surface of the drawer D1 in the lateral direction, and may extend in the forward-rearward direction.

The hook 422 may include a first part 422*a* protruding upward from the upper surface 421 of the first moving rail 42 and a second part 422*b* extending forward from the upper end of the first part 422*a*. The horizontal rib 321*a* may be provided with a coupling hole (not shown) having an appropriate shape. The hook 422 may extend upward through the coupling hole. In this embodiment, the drawer D1 and the first moving rail 42 move simultaneously as the result of the coupling between the horizontal rib 321*a* and the hook 422. However, the present invention is not limited thereto. The drawer D1 and the first moving rail 42 may be coupled to each other in other different manners within a range in which the drawer D1 and the first moving rail 42 move simultaneously.

The drawer D1 and the first moving rail 42 may be coupled to each other such that a user can easily separate the drawer D1 and the first moving rail 42 from each other without using a tool. That is, the drawer D1 and the first moving rail 42 may be coupled to each other based on a structure in which the drawer D1 and the first moving rail 42 may be coupled to each other such that the drawer D1 and the first moving rail 42 can be manually separated from each other by the user, rather than a structure in which the drawer D1 and the first moving rail 42 are coupled to each other using a screw or bolt such that the state of coupling between the drawer D1 and the first moving rail 42 is maintained before the drawer D1 and the first moving rail 42 are separated from each other using a tool. In this embodiment, the user may appropriately move the drawer D1 to insert the hook 422 of the first moving rail 42 into the coupling hole formed in the horizontal rib 321*a* or to separate the hook 422 from the coupling hole. After being separated from the first moving rail 42, the drawer D1 may be withdrawn out of the storage compartment S3.

Meanwhile, the drawer connection member 321 may further include a vertical rib 321*b* extending downward from one end of the horizontal rib 321*a*. The vertical rib 321*b* may abut a first side surface 423 of the first moving rail 42. In other embodiments, a screw or bolt (hereinafter, referred to as a "fastening member") for coupling the vertical rib 321*b* to the first side surface 423 may be further provided. The first side surface 423 of the first moving rail 42 is located at one of two side surfaces 423 and 424 extending downward from the opposite sides of the horizontal upper surface 421 of the first moving rail 42 that is closer to the first strip part 411.

The second strip part 412 is provided with an inverse "V"-shaped (i.e. an upward concave-shaped) notch 412*a*. A lower maintenance protrusion 143*a* of a bracket 14, a description of which will follow, may be inserted into the notch 412*a*. The notch 412*a* may be formed in the portion of the second strip part 412 that meets the pocket 413.

A bracket 14 for installing each drawer guide 40*a* may be disposed at the side surface S(s) of the storage compartment S3. The bracket 14 may protrude from the side surface S(s) of the storage compartment S3 toward the drawer D1. The bracket 14 may extend in the forward-rearward direction.

The bracket 14 may be provided with a rail installation groove 14*a*, which extends in the forward-rearward direction. The stationary rail 41 is installed in the rail installation groove 14*a*. The rail installation groove 14*a* may be defined by a vertical surface 141 extending in the forward-rearward direction while being approximately parallel to the side surface S(s) of the storage compartment S3 and an upper horizontal surface 142 and a lower horizontal surface 143 horizontally protruding respectively from the upper end and the lower end of the vertical surface 141 while extending in the forward-rearward direction.

An elastic support tab 144, which is formed by cutting the vertical surface 141, may be provided in the rail installation groove 14*a*. The elastic support tab 144 may be elastically turned with respect to the vertical surface 141. The elastic support tab 144 is pushed by the first strip part 411 of the stationary rail 41 in the lateral direction.

In the state in which the stationary rail 41 is installed in the rail installation groove 14*a*, the elastic support tab 144 remains pushed by the stationary rail 41, i.e. deformed. Since the elastic support tab 144 is elastically deformed, the elastic support tab 144 may return to the original state thereof when external force is removed (i.e. when the stationary rail 41 is separated).

The bracket 14 may further include an upper maintenance protrusion 142*a* protruding downward from the upper horizontal surface 142 of the rail installation groove 14*a* and/or a lower maintenance protrusion 143*a* protruding upward from the lower horizontal surface 143.

In the state in which the first strip part 411 of the stationary rail 41 is inserted into the rail installation groove 14*a*, the upper end of the first strip part 411 is located between the vertical surface 141 and the upper maintenance protrusion 142*a*. In particular, the gap between the vertical surface 141 and the upper maintenance protrusion 142*a* is formed so as to correspond to the thickness of the first strip part 411. Consequently, the lateral movement of the upper end of the first strip part 411 is limited by the upper maintenance protrusion 142*a*, whereby the upper end of the first strip part 411 is prevented from escaping from the gap.

The second strip part 412 may be located on the lower horizontal surface 143. The lower horizontal surface 143 may have a larger width than the upper horizontal surface 142. The lower maintenance protrusion 143*a* may be formed at a position closer to the drawer D1 than the upper maintenance protrusion 142*a* by a distance corresponding to the difference in width between the lower horizontal surface 143 and the upper horizontal surface 142.

The lower maintenance protrusion 143*a* may be inserted into the notch 412*a* of the stationary rail 41. The lateral movement of the lower maintenance protrusion 143*a* is limited by the notch 412*a*. The lower end of the stationary rail 41 may be securely coupled to the bracket 14 by fastening force between the lower maintenance protrusion 143*a* and the notch 412*a*.

In the state in which the stationary rail 41 is installed at the bracket 14, the first strip part 411 is pushed by the elastic support tab 144 in the lateral direction (i.e. toward the drawer D1). As a result, the upper end of the first strip part 411 is in tight contact with the upper maintenance protrusion 142*a*. In this state, the lower maintenance protrusion 143*a* is inserted into the notch 412*a*. Consequently, the stationary rail 41 is securely supported without shaking.

In the above description, the rail installation groove 14*a* is formed in the bracket 14, and the bracket 14 is coupled to the side surface S(s) of the storage compartment S3, by way of example. However, the present invention is not limited thereto. The bracket 14 may be formed integrally with the inner surface 11 of the cabinet, which defines the side surface S(s) of the storage compartment S3, or the vertical partition 20.

Referring to FIG. 3, the withdrawal mechanism 50*a* may move in response to the opening and closing operation of the door 3*c*. The withdrawal mechanism 50*a* may move forward when the door 3*c* is opened. The withdrawal mechanism 50*a* may move rearward when the door 3*c* is closed. The drawers D1, D2, and D3 are moved in response to the operation of the withdrawal mechanism 50*a*. In particular, the withdrawal mechanism 50*a* may move the drawers D1, D2, and D3 forward when the door 3*c* is opened. In FIG. 3, the positions of the withdrawal mechanism 50*a* and the drawers D1, D2, and D3 in the state in which the door 3*c* is closed are indicated by dotted lines. When the door 3*c* is opened in this state, the withdrawal mechanism 50*a* pushes the drawers D1, D2, and D3 forward while moving forward. The positions of the withdrawal mechanism 50*a* and the drawers D1, D2, and D3 at this time are indicated by solid lines.

Since the drawers D1, D2, and D3 are located forward by a predetermine distance from the positions at which the drawers D1, D2, and D3 are initially received (i.e. the positions of the drawers D1, D2, and D3 in the state in which the door 3*c* is closed; hereinafter, referred to as "original positions") in the state in which the opening of the front surface S(f) of the storage compartment S3 is open as the result of opening of the door 3*c*, the user easily accesses the drawers D1, D2, and D3, with the result that the user can easily take food out of the drawers D1, D2, and D3 or put food in the drawers D1, D2, and D3. Such convenience is particularly critical for a large-capacity refrigerator having a deep storage compartment S3.

Referring to FIGS. 4, 8, and 9*a* to 9*c*, the withdrawal mechanism 50*a* may include a base part 51 disposed at the lower side of the drawer D3 and a rear frame 52 extending upward from the base part 51. At least a portion of the rear frame 52 is disposed at the rear of the drawers D1, D2, and D3. The rear frame 52 may extend toward the upper surface S(u) of the storage compartment S3 through the space between the drawers D1, D2, and D3 and the rear surface S(r) of the storage compartment S. The rear frame 52 may extend up to at least a height corresponding to the drawer D1.

The refrigerator 1*a* may include a withdrawal mechanism guide 60*a* for guiding the withdrawal mechanism 50*a* such that the withdrawal mechanism 50*a* is movable in the forward-rearward direction. The withdrawal mechanism guide 60*a* may be disposed between each side surface S3 of the storage compartment S3 and the base part 51, or may be disposed at each side of the base part 51. The withdrawal mechanism guide 60*a* may include rails 61 disposed at one of the side surfaces S(s) of the storage compartment S3 and the base part 51 and rollers 62 disposed at the other of the side surfaces S(s) of the storage compartment S3 and the base part 51 so as to rotate as the result of contact with the rails 61 during the movement of the base part 51. In this embodiment, the withdrawal mechanism 50*a* may include rails 61 fixed to the side surfaces S(s) of the storage compartment S3 and extending in the forward-rearward direction and rollers 62 rotatably mounted to the side surfaces 512 and 513 of the base part 51 so as to roll along the rails 61 during the movement of the withdrawal mechanism 50*a*. However, the present invention is not limited thereto. In place of the rollers 62, moving rails (not shown) engaged with the rails 61 may be provided at the base part 51.

In addition, the rollers 62 may be fixed to the side surfaces S(s) of the storage compartment S3, and the rails 61 may be disposed at the side surfaces 512 and 513 of the base part 51 such that the rails 61 move while being supported by the rollers 62.

Furthermore, the withdrawal mechanism guide 60*a* may be disposed between the bottom surface S(b) of the storage compartment S3 and a bottom surface 511 of the base part 51. For example, a stationary rail may be disposed at the bottom surface S(b) of the storage compartment S3, and a moving rail, which is engaged with the stationary rail so as to move along the stationary rail when the base part 51 is moved, may be disposed at the bottom surface 511 of the base part 51.

The base part 51 includes a horizontal bottom surface 511. The upper side of the bottom surface 511 faces upward, and the bottom side of the bottom surface 511, which is opposite the upper side, faces the bottom surface S(b) of the storage compartment S. In the case in which a plurality of drawers D1, D2, and D3 is arranged in the upward-downward direction, as in this embodiment, the base part 51 may be disposed lower than the lowermost drawer D3.

The link 70 connects the door 3*c* and the base part 51. One end of the link 70 may be turnably connected to the door 3*c*, and the other end of the link 70 may be turnably connected to the base part 51.

Referring to FIGS. 9*a* to 9*c*, the base part 51 may have a structure in which the front surface and the upper surface of the base part 51 are open. Specifically, the base part 51 may include a horizontal bottom surface 511, a pair of side surfaces 512 and 513 extending upward from opposite ends of the bottom surface 511, and a rear surface 514 extending upward from the rear end of the bottom surface 511 for interconnecting the side surfaces 512 and 513.

The rear frame 52 may include a pair of vertical bars 520*a* and 520*b* extending upward from the base part 51 while being spaced apart from each other in the width direction of the storage compartment S3. Each of the vertical bars 520*a* and 520*b* may extend upward from the rear surface 514. Hereinafter, the vertical bars 520*a* and 520*b* will be referred to as a first vertical bar 520*a* and a second vertical bar 520*b* when it is necessary to distinguish the vertical bars 520*a* and 520*b* from each other.

The first vertical bar 520*a* and the second vertical bar 520*b* may not be formed as separate members. The first vertical bar 520*a* and the second vertical bar 520*b* may be formed as a single body using a single frame member 520 formed in a bend or beam shape having a length larger than a width w (see FIG. 9*a*). That is, the frame member 520 may include sections 521 to 524 forming the first vertical bar 520*a*, sections forming the second vertical bar 520*b*, and a connection section 520*c* for connecting the first vertical bar 520*a* and the second vertical bar 520*b*. The first vertical bar 520*a* and the second vertical bar 520*b* are formed in substantially the same shape, and are parallel to each other.

Since the first vertical bar 520*a* and the second vertical bar 520*b* are spaced apart from each other, cool air may pass through therebetween. Consequently, the cool air may be supplied deeply to the inside of the storage compartment S3. Particularly, in the case in which a discharge port, through which cool air is discharged, is formed in the rear surface S(r) of the storage compartment S3, the cool air discharged through the discharge port may be uniformly distributed in the storage compartment S3.

The connection section 520*c* may be disposed at the lower side of the base part 51 to support the base part 51. The connection section 520*c* may be coupled to the base part 51 using a fastening member. The connection section 520*c* may include a section 545*a* extending forward from the lower end of the first vertical bar 520*a*, a section 545*b* extending forward from the lower end of the second vertical bar 520*b*, and a section 546 extending in the width direction of the storage compartment S3 between the sections 545*a* and 545*b*. The section 546 is perpendicular to the section 545*a* and the section 545*b*.

The frame member 520 may be formed by injection-molding a synthetic resin. Alternatively, the frame member 520 may be formed by pressing a metal material. The surface of the bar 520 that defines the width w of the bar 520 and the outer surface of the base part 51 may be coupled to each other using a fastening member.

The lower ends of the vertical bars 520*a* and 520*b* may be located on the rear side of the rear surface 514 of the base part 51. Fastening members 56 for coupling the lower ends and the rear surface 514 may be further provided. The fastening members 56 may be fastened to two or more spaced points of the vertical bars 520*a* and 520*b* in the longitudinal direction of the vertical bars 520*a* and 520*b*.

The vertical bars 520*a* and 520*b* may be disposed symmetrically with a middle line M (see FIG. 9*b*) equally dividing the rear surface 514 in the width direction, i.e. a line connecting portions located equidistant from the side surfaces 512 and 513 of the base part 51.

Referring to FIG. 9*c*, the rear surface 514 of the base part 51 may extend upward from the bottom surface 511 of the base part 51 while being inclined rearward. Each of the vertical bars 520*a* and 520*b* may include a first inclined section 521, the lower end of which is located on the rear side of the rear surface 514 of the base part 51 and which extends upward from the lower end while being inclined at an inclination corresponding to the inclination of the rear surface 514, and a first vertical section 522 vertically extending from the first inclined section 521 to at least a height corresponding to the lowermost one of the drawers D1, D2, and D3, i.e. the drawer D3 (i.e. to at least a height at which the first vertical section 522 can contact the drawer D3). In particular, the first vertical section 522 may come into contact with the rear surface of the drawer D3 during the movement of the withdrawal mechanism 50*a*.

In addition, each of the vertical bars 520*a* and 520*b* may include a second inclined section 523 extending upward from the first vertical section 522 while being inclined rearward and a second vertical section 524 vertically extending from the second inclined section 523 to at least a height corresponding to the drawer D2, which is disposed above the drawer D3 (i.e. to at least a height at which the 50*a* can contact the drawer D2). In this embodiment, the second vertical section 524 extends to a height at which the second vertical section 524 can contact the drawer D1, since three drawers D1, D2, and D3 are provided.

The rear surface of the drawer D3, which is opposite the vertical bars 520*a* and 520*b*, may have a shape corresponding to the first inclined section 521. During the movement of the withdrawal mechanism 50*a*, the rear surface of the drawer D3 may contact the first vertical section 521.

The rear surface 514 of the base part 41 may extend higher than the side surfaces 512 and 513, and may contact the vertical bars 520*a* and 520*b* above the side surfaces 512 and 513. That is, the rear surface is formed so as to extend higher than the side surfaces 512 and 513. Consequently, the contact area between the rear surface and the vertical bars 520*a* and 520*b* is increased, with the result that the vertical bars 520*a* and 520*b* may be supported more stably.

In particular, the vertical bars 520*a* and 520*b* may be coupled to the rear surface 514 of the base part 51. Specifically, the first inclined section 521 of each of the vertical bars 520*a* and 520*b* is coupled to the rear surface 514 using the fastening members 56. In the structure in which the vertical bars 520*a* and 520*b* are coupled to the rear surface 514, the rear surface 514 securely holds the lower ends of the vertical bars 520*a* and 520*b*. Even though reaction force from the drawers D1, D2, and D3 (e.g. repulsive force generated by inertia in rest of the drawers D) is applied to the vertical bars 520*a* and 520*b* when the withdrawal mechanism 50*a* pushes the drawers D1, D2, and D3 forward, therefore, the vertical bars 520*a* and 520*b* are prevented from easily drooping or being curved rearward.

In addition, the vertical bars 520*a* and 520*b* are connected to each other via the connection section 520*c*, the connection section 520*c* has a '['-shaped frame structure constituted by the sections 545*a*, 545*b*, and 546, and the connection section 520*c* is in tight contact with or coupled to the bottom side of the bottom surface 511 of the base part 51. Consequently, the connection section 520*c* prevents the vertical bars 520*a* and 520*b* from drooping rearward due to repulsive forces from the drawers D1, D2, and D3.

In addition, the first vertical bar 520*a* and the second vertical bar 520*b* are not separated from each other but are integrally connected to each other via the connection section 520*c*. Even when forces of different magnitudes are applied to the vertical bars 520*a* and 520*b*, therefore, the forces are distributed by the connection section 520*c*, with the result that the forces are uniformly applied to the vertical bars 520*a* and 520*b*. Consequently, twisting of the rear frame 52 is prevented.

Meanwhile, the rear frame 52 may further include a connection bar 530 for interconnecting the first vertical bar 520*a* and the second vertical bar 520*b* above the base part 51. The connection bar 530 may structurally stabilize the first vertical bar 520*a* and the second vertical bar 520*b*. In particular, the connection bar 530 may prevent the increase in distance between the first vertical bar 520*a* and the second vertical bar 520*b*. In addition, in this structure, one of the vertical bars (e.g. the vertical bar 520*a*) is prevented from drooping rearward further than the other vertical bar (e.g. the vertical bar 520*b*) even in the case in which the magnitudes of forces applied from the drawers D1, D2, and D3 to the vertical bars 520*a* and 520*b* are different from each other when the withdrawal mechanism 50*a* pushes the drawers D1, D2, and D3.

The connection bar 530 may interconnect the upper parts of the first vertical bar 520*a* and the second vertical bar 520*b*. The connection bar 530 may be coupled to the second vertical sections 524 of the vertical bars 520*a* and 520*b*. Specifically, the connection bar 530 is coupled to the upper ends of the second vertical sections 524, rather than to the lower ends of the second vertical sections 524 (i.e. the ends of the second vertical sections 524 that are connected to the second inclined sections 523).

Referring to FIGS. 9*a* to 9*c*, the rear frame 52 may include arms 532 and 533 extending forward from the vertical bars 520*a* and 520*b* so as to be guided along arm guides 91. The arms 532 and 533 may be integrally formed with the connection bar 530, although the arms 532 and 533 may extend from the vertical bars 520*a* and 520*b*.

The connection bar 530 may include a connection part 531 extending in the width direction of the storage compartment S3 for interconnecting the vertical bars 520*a* and 520*b*. The connection part 531 is coupled to the vertical bars 520*a* and 520*b*. Opposite ends of the connection part 531 may protrude from the vertical bars 520*a* and 520*b* toward the side surfaces S(s) of the storage compartment S3. The arms 532 and 533 may extend forward from the opposite ends of the connection part 531. The arms 532 and 533 may be disposed between the drawer D1 and the side surfaces S(s) of the storage compartment S3. Each of the arms 532 and 533 may be provided with a roller 92. The rollers 92 may roll along the arm guides 91 during the movement of the withdrawal mechanism 50*a*.

Referring to FIGS. 4 and 5, the arm guides 91 may be disposed at the side surfaces S(s) of the storage compartment S3. Specifically, the arm guides 91 may be located higher than the drawer guide 40*a* for supporting the uppermost drawer D1.

The arm guides 91 may include roller guide surfaces 91*b* extending in the direction in which the rollers 91 are moved, i.e. in the forward-rearward direction of the storage compartment S3, so as to contact the rollers 91 at the lower sides of the rollers 91. The roller guide surfaces 91*b* may be level.

As shown in FIG. 5, each arm guide 91 may have a guide groove 91*a*, which has a '['-shaped section that is open toward the drawer D. The roller 92 may be supported by the roller guide surface 91*b* in the guide groove 91*a*. The guide groove 91*a* may further include an upper surface 91*c* provided above the roller guide surface 91*b* so as to be parallel to the roller guide surface 91*b*. The distance between the roller guide surface 91*b* and the upper surface 91*c* is slightly greater than the diameter of the roller 92 such that the roller 92 does not contact the upper surface 91*c* when the roller 92 rolls along the roller guide surface 91*b*.

The reaction force applied from the drawers D1, D2, and D3 to the rear frame 52 during the movement of the withdrawal mechanism 50*a* may cause the vertical bars 520*a* and 520*b* to pivot rearward about the connections thereof with the base part 51 (i.e. may cause the vertical bars 520*a* and 520*b* to droop rearward). However, the downward displacement of the roller 92 due to the tendency of the vertical bars 520*a* and 520*b* to droop is prevented by the roller guide surface 91*b*. As a result, the vertical bars 520*a* and 520*b* are prevented from drooping rearward.

Meanwhile, in the refrigerator 1*a* according to this embodiment, the door 3*c* and the base part 51 are connected to each other via the link 70, which is a means for moving the withdrawal mechanism 50*a* in response to the opening and closing operation of the door 3*c*. However, the present invention is not limited thereto. In other embodiments, the base part 51 may be moved by a driving means, such as an electric motor or an electric actuator. For example, in the case in which a motor is provided as the driving means, the base part 51 may be moved by a power conversion means that converts the rotational force of the motor into a rectilinear motion. An example of the power conversion means may include a rack and pinion or a crank. The driving means may be operated in response to the opening and closing operation of the door 3*c*. That is, when the door 3*c* is opened, the driving means may be operated such that the withdrawal mechanism 50*a* is moved forward by the power conversion means. Furthermore, when the door 3*c* is closed, the driving means may be operated such that the withdrawal mechanism 50*a* is moved rearward by the power conversion means.

Meanwhile, in this embodiment, the withdrawal mechanism 50*a* is separated from the drawers D1, D2, and D3. That is, the drawers D are not coupled or fastened to the rear frame 52. When the door 3*c* is opened, therefore, the drawers D1, D2, and D3 move forward as the result of contact with the rear frame 52. However, such contact between the rear frame 52 and the drawers D1, D2, and D3 is temporarily achieved to move the drawers D1, D2, and D3. Particularly, in the case in which the drawers D1, D2, and D3 are supported by the drawer guides 40*a* in a state of static mechanical equilibrium, the rear frame 52 merely pushes and moves the drawers D1, D2, and D3 without supporting the loads of the drawers D1, D2, and D3 even when contact between the rear frame 52 and the drawers D1, D2, and D3 is temporarily achieved. This is equally applied even in the case in which the rear frame 52 is continually coupled to the drawers D1, D2, and D3 in other embodiments.

In the structure in which the drawers D1, D2, and D3 are separated from or not coupled to the withdrawal mechanism 50*a*, the movement of the drawers D1, D2, and D3 may be achieved by separable contact between the withdrawal mechanism 50*a* and the drawers D1, D2, and D3. That is, when the withdrawal mechanism 50*a* moves forward in response to the opening operation of the door 3*c*, the rear frame 52 of the withdrawal mechanism 50*a* contacts the drawers D1, D2, and D3, with the result that the drawers D1, D2, and D3 are pushed by the rear frame 52. However, the contact between the rear frame 52 and the drawers D1, D2, and D3 may be released as needed. For example, when the user stops turning the door 3*c* and closes the door 3*c* again while the drawers D1, D2, and D3 are pushed forward by the rear frame 52, the contact between the rear frame 52 and the drawers D1, D2, and D3 may be released, at least temporarily.

However, the present invention is not limited thereto. The withdrawal mechanism 50*a* (particularly, the rear frame 52) may be continually coupled to the drawers D1, D2, and D3. Even in this case, the loads of the drawers D1, D2, and D3 are not applied to the withdrawal mechanism 50*a*, as long as the drawers D1, D2, and D3 are supported by the drawer guides 40*a* in a state of static mechanical equilibrium. In this case, however, the withdrawal mechanism 50*a* may move the drawers D1, D2, and D3 rearward when the door 3*c* is closed.

FIG. 10*a* is a view showing the bottom surface of the base part 51 exposed in the state in which the door 3*c* is closed. FIG. 10*b* is a view showing the state in which the door 3*c* of FIG. 10*a* is open to a withdrawal start angle. FIG. 10*c* is a view showing the state in which the door 3*c* of FIG. 10*b* is fully open. Referring to FIGS. 10*a* to 10*c*, a front end 71 of the link 70 may be turnably connected to the door 3*c*, and a rear end 72 of the link 70 may be turnably connected to the base part 51. That is, the front end 71 may be turnably coupled to the door 3*c* so as to constitute a first turning joint J1, and the rear end 72 may be turnably coupled to the base part 51 so as to constitute a second turning joint J2.

The first turning joint J1 is spaced apart from the center of turning of the door 3*c* with respect to the cabinet 10, i.e. a turning axis C of the door 3*c*, by a predetermined distance r. When the door 3*c* is turned, therefore, the first turning joint J1 moves along the circumference of a circle having a radius r about the turning axis C of the door 3*c*. Since the position of the first turning joint J1 is variable on the circumference of the circle, the second turning joint J2 is displaced, with the result that the base part 51 is moved. The first turning joint J1 and the second turning joint J2 may be opposite each other about a reference line L that is located equidistant from the withdrawal mechanism guides 60, which are disposed at the opposite sides of the base part 51. In this embodiment, the withdrawal mechanism guides 60 are disposed symmetrically with respect to the base part 51. Consequently, the reference line L is substantially the same as a middle line of the base part 51, i.e. a line that is located equidistant from the side surfaces 512 and 513 of the base part 51.

Although the position of the second turning joint J2 relative to the base part 51 may be fixed, the position of the second turning joint J2 relative to the base part 51 may be variable within a predetermined portion of the entire range in which the door 3*c* is turned, as in this embodiment. For example, the base part 51 may be provided with a slit 517 extending in the forward-rearward direction, and the second turning joint J2 may move along the slit 517. To this end, the link 70 may be provided in the rear end 72 thereof with a fastening hole, into which a fastening member is fastened. The fastening member is fastened into the fastening hole through the slit 517. That is, the second turning joint J2 is a movable turning joint that is capable of moving along the slit 517 and turning with respect to the base part 51 in response to the turning operation of the door 3*c*. The slit 517 may have a predetermined distance such that the second turning joint J2 is movable with respect to the base part 51. The fastening member may be moved along the slit 517.

The rear end 72 of the link 70 may be located on the bottom surface of the base part 51. A washer 78 (see FIG. 4) may be disposed on the upper surface of the base part 51. The fastening member may be fastened to the washer 78 through the slit 57 and the fastening hole.

In the state in which the door 3*c* is closed, the rear end 72 of the link 70 is located at the initial position (see FIG. 10*a*). At the initial position, the rear end 72 of the link 70 may be spaced apart from the front end of the slit 517 by a predetermined distance. Specifically, the rear end 72 of the link 70 abuts the rear end of the slit 517.

When the door 3*c* starts to be opened in the state in which the door 3*c* is closed, the rear end 72 of the link 70 moves along the slit 517 until the opening angle of the door 3*c* reaches a predetermined withdrawal start angle θ (see FIG. 10*b*). At this time, the base part 51 may remain stationary. That is, the drawers D1, D2, and D3 do not move until the opening angle of the door 3*c* reaches a predetermined withdrawal start angle θ.

The withdrawal start angle θ is the opening angle of the door 3*c* until the rear end 72 of the link 70 or the second turning joint J2 moves from the initial position (i.e. the position in the state in which the door 3*c* is closed) to the front end of the slit 517. As the opening angle of the door 3*c* exceeds the withdrawal start angle θ, the second turning joint J2 moves together with the base part 51, and the drawers D1, D2, and D3 are moved forward (i.e. withdrawn). While the second turning joint J2 moves from the initial position to the front end of the slit 517, the door 3*c* is turned, but the drawers D1, D2, and D3 or the base part 51 is not moved. Consequently, a section in which the door 3*c* is opened while being turned from the state in which the door 3*c* is closed to the withdrawal start angle θ is defined as a withdrawal delay section.

The withdrawal delay section is necessary to prevent the drawers D1, D2, and D3 from colliding with the rear surface of the door 3*c* or the elements installed at the rear surface of the door 3*c* (e.g. the door storage unit 8*a*, 8*b*, and 8*c*). That is, if the withdrawal delay section is not provided, the drawers D1, D2, and D3 move immediately when the door 3*c* starts to be opened in the state in which the door 3*c* is closed, with the result that the drawers D1, D2, and D3 move forward before the rear surface of the door 3*c* or the protruding structure, such as the door storage unit 8*a*, 8*b*, and 8*c*, installed on the rear surface of the door 3*c* deviates from the movement paths of the drawers D1, D2, and D3, whereby the drawers D may collide with the rear surface of the door 3*c* (or the protruding structure).

In addition, a gasket (not shown) for sealing the storage compartment S3 is provided at the rear surface of the door 3*c*. In the state in which the door 3*c* is closed, the gasket is in tight contact with the front surface S(f) of the cabinet 10. Force necessary to overcome magnetic force between a magnet mounted in the gasket and the cabinet 10 is required at the beginning when the door 3*c* is opened, i.e. until the gasket is separated from the front surface S(f) of the cabinet 10. Consequently, a relatively large force must be applied to the door 3*c*. Before the gasket is separated from the front surface S(f) of the cabinet 10, the withdrawal mechanism 50*a* is not moved such that force applied by the user is used only to open the door 3*c* (i.e. only to separate the gasket from the front surface S(f) of the cabinet 10) until the gasket is separated from the front surface S(f) of the cabinet 10. When the door 3*c* is opened to the withdrawal start angle θ after the gasket is separated from the front surface S(f) of the cabinet 10, the withdrawal mechanism 50*a* is moved.

The withdrawal start angle θ may be 90 degrees or less, preferably 70 to 80 degrees. If the distance that the base part 51 is moved until the door 3*c* is fully opened from the withdrawal start angle θ is defined as a withdrawal distance, the withdrawal distance may be set to about 10 cm.

When the door 3*c* is turned to the withdrawal start angle θ, the rear end 72 of the link 72 is located at the front end of the slit 517. Consequently, the base part 51 is moved, with the result that the drawers D1, D2, and D3 are also moved.

The drawers D1, D2, and D3 do not pass over the front surface S(f) of the storage compartment S3 even in the state in which the drawers D1, D2, and D3 are moved by the withdrawal distance. However, the movable range of the drawers D1, D2, and D3 that is allowed by the drawer guides 40*a* is not limited such that the drawers D1, D2, and D3 do not pass over the front surface S(f) of the storage compartment S3. That is, the drawers D1, D2, and D3 are located at positions where the drawers D1, D2, and D3 do not pass over the front surface S(f) of the storage compartment S3 even in the state in which the door 3*c* is fully open. However, this means that the drawers D1, D2, and D3 are automatically withdrawn to the final positions thereof by the withdrawal mechanism 50*a*. In other embodiments, the user may further withdraw the drawers D1, D2, and D3 manually. To this end, the drawer guides 40*a* may be configured to guide the movement of the drawers D1, D2, and D3 such that the drawers D1, D2, and D3 pass over the distance to which the drawers D1, D2, and D3 are automatically withdrawn by the withdrawal mechanism 50*a*.

The link 70 may include a first bent section 73 extending from the front end 71 and bent convexly in the direction away from the turning axis C of the door 3*c* and a second bent section 74 located between the first bent section 73 and the rear end 72 and bent convexly in the direction opposite the first bent section 73.

Since the front end 71 of the link 70 is spaced apart from the turning axis C of the door 3*c*, a portion of the door 3*c*, particularly a part of the door 3*c* between the turning axis C and the front end 71 (e.g. a corner of the door 3*c*), may interfere with the link 70 when the door 3*c* is turned. it is necessary to solve this problem in the case in which the front end 71 of the link 70 is connected to the door 3*c* at a position at which the front end 71 of the link 70 is spaced apart upward from the bottom surface of the door 3*c* by a predetermined distance or in the case in which the link 70 is formed so as to be bent in the upward-downward direction even though the link 70 is coupled to the bottom surface of the door 3*c*. In order to solve this problem, the link 70 includes a first bent section 73 extending from the front end 71 and bent convexly in the direction away from the turning axis C of the door 3*c*.

If the first bent section 73 is formed over the entirety of the link 70, it is easy to avoid interference between the door 3*c* and the link 70. Since the first bent section 73 is convex, however, it is difficult to configure the link 70 such that the link is hidden by the door 3*c* or the base part 51 during the opening and closing operation of the door 3*c*. In addition, it is also difficult to space the second turning joint J2 apart from the turning axis C of the door 3*c*. For this reason, the second bent section 74, which is convex in the direction opposite the direction in which the first bent section 73 is convex, is provided between the first bent section 73 and the rear end 72 of the link. The first bent section 73 and the second bent section may be convex in opposite directions with respect to a straight line connecting the front end 71 and the rear end 72.

FIG. 11 is a view showing the positions of the first turning joint J1 and the second turning joint J2 during opening of the door 3*c* in a comparative example. FIG. 12 is a view showing the positions of the first turning joint J1 and the second turning joint J2 during opening of the door in the refrigerator 1*a* according to the embodiment of the present invention. FIG. 13 is a view showing forces shown in FIGS. 11 and 12 on a coordinate system.

As shown in FIG. 11, which is provided for comparison with the present invention, the front end 71 and the rear end 72 of the link 70 are located on the same side with respect to the reference line L (i.e. the first turning joint J1 and the second turning joint J2 are located on the same side with respect to the reference line L).

In FIG. 11, the straight distance between the turning axis C of the door 3*c* and the first turning joint J1 is indicated by r1, the position of the first turning joint J1 when the door 3c starts to be opened in the closed state and is turned to the withdrawal start angle θ is indicated by J1(θ), and the position of the first turning joint J1 when the door 3c is further turned by Δθ is indicated by J1(θ+Δθ).

The second turning joint J2 is located at position P1. (In FIG. 11, J2(P1) indicates the second turning joint J2 at position P1.) P1 is a point on a circle T1 having the first turning joint J1 as the center and the straight line r2 between the first turning joint J1 and the second turning joint J2 (hereinafter, referred to as the "link length") as the radius. The second turning joint J2 is allowed to move relative to the base part 51 (i.e. is configured to have a structure in which delayed withdrawal is possible). After the second turning joint J2 reaches position P1, the movement of the base part 51 is started. If the second turning joint J2 is fixed to the base part 51 with the result that no delayed withdrawal section is provided, however, position P1 may be a position at a point of time during the movement of the base part 51 (i.e. at the time at which the door 3c is rotated by the angle θ).

When the door 3c is further turned by Δθ (the position of the first turning joint J1 at this time being indicated by J1(θ+Δθ)), the first turning joint J1 is displaced. In addition, the second turning joint J2 reaches position P2. (In the figure, J2(P2) indicates the second turning joint J2 at position P2.) In the following example, the door 3c is fully open when the second turning joint J2 is at position P2.

During opening of the door 3c, the base part 51 is guided to move forward (in the Y-axis direction) by the withdrawal mechanism guide 60. Q indicates the movement path of the second turning joint J2. In addition, y1 indicates the distance that the second turning joint J2 is moved forward, i.e. the distance that the base part 51 is withdrawn.

Referring to FIG. 12, in the refrigerator 1a according to the embodiment of the present invention, the second turning joint J2 moves from position P1' to position P2' on the movement path Q' thereof while the door 3c is turned from the withdrawal start angle θ until the door 3c is fully open. The displacement of the second turning joint J2 at this time is indicated by y2.

In FIG. 12, J2(P1') indicates that the second turning joint J2 is located at position P1' when the door 3c starts to be opened in the closed state and is turned to the withdrawal start angle θ. At this time, P1' is a point on a circle T1' having the first turning joint J1 as the center and the link length r2 as the radius in the state in which the door 3c is turned to the withdrawal start angle θ. In addition, at this time, the position of the first turning joint J1 is indicated by J1(θ).

J2(P2') indicates the second turning joint J2 located at position P2' in the state in which the door 3c is further turned by A. At this time, P2' is a point on a circle T2' having the first turning joint J1 as the center and the link length r2 as the radius in the state in which the door 3c is further turned by A from the withdrawal start angle θ. In addition, at this time, the position of the first turning joint J1 is indicated by J1(θ+Δθ).

When comparing FIGS. 11 and 12, in the case in which the distance r1 between the turning axis C of the door 3c and the first turning joint J1 in FIG. 11 is equal to the distance r1 between the turning axis C of the door 3c and the first turning joint J1 in FIG. 12 and in the case in which the link length r2 in FIG. 11 is equal to the link length r2 in FIG. 12, it can be seen that, when the door 3c in the comparative example and the door 3c in the present invention are turned by the same angle Δθ, the second turning joint J2 in the present invention moves further than the second turning joint J2 in the comparative example (y2>y1). This difference results from the fact that the present invention is different from the comparative example in terms of the position at which the second turning joint J2 is connected to the base part 51. Particularly, in the case in which the turning axis C of the door 3c is relatively close to the second turning joint J2, as in the comparative example, the door 3c must be turned further in order to move the base part 51 the same distance. In addition, the delayed withdrawal distance must be short. In the case in which the delayed withdrawal distance is short, however, a possibility of collision between the door 3c and the drawers D1, D2, and D3 is increased. In order to solve this problem, therefore, the first turning joint J1 and the second turning joint J2 may be opposite each other about the reference line L. Furthermore, the second turning joint J2 may be located closer to the withdrawal mechanism guide 60 than the reference line L.

Meanwhile, on the assumption that force F1 applied from the link 70 to the base part 51 at position P1 in the comparative example is equal to force F1' applied from the link 70 to the base part 51 at position P1' in the present invention, these forces may be shown on an XY coordinate system as shown in FIG. 13. FIG. 13 shows that even in the case in which the door 3c in the comparative example and the door 3c in the present invention are turned by the same withdrawal start angle θ, F1 has a larger Y-axis component value than F1', which means that it is possible to move forward (i.e. in the Y-axis direction) using force having the same magnitude in the present invention more easily than in the comparative example. This difference between the present invention and the comparative example appears over the section in which the base part 51 is moved (i.e. the section in which the door 3c is turned from the withdrawal start angle θ by Δθ).

Particularly, since the X-axis components (i.e. the components in the width direction of the storage compartment S3) of forces F1 and F2 applied to the base part 51 are large in the comparative example, the base part 51 may more easily shake in the leftward-rightward direction when the baser part 51 is moved while being guided by the withdrawal mechanism guide 60 than in the present invention.

Those skilled in the art to which the present invention pertains will appreciate that the present invention may be carried out in specific ways other than those set forth herein without departing from the spirit and essential characteristics of the present invention. The above embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

The invention claimed is:

1. A refrigerator comprising:

a cabinet having a storage compartment therein, the storage compartment being provided in a front surface thereof with an opening;

a door hinged to the cabinet for opening and closing at least a portion of the opening;

a drawer disposed in the storage compartment for storing goods;

a drawer guide for supporting the drawer and guiding the drawer so as to be movable in a forward-rearward direction;

a withdrawal mechanism comprising a base part disposed at a lower side of the drawer and a rear frame extending from the base part toward a rear of the drawer for pushing the drawer forward when the base part is moved forward;

a link having a front end connected to the door at a position spaced apart from a turning axis of the door with respect to the cabinet by a predetermined distance so as to constitute a first turning joint and a rear end connected to the base part so as to constitute a second turning joint; and a pair of withdrawal mechanism guides disposed so as to be spaced apart from each other in a width direction of the storage compartment for guiding the base part so as to be movable in the forward-rearward direction, wherein the first turning joint and the second turning joint are opposite each other about a reference line located substantially equidistant from the withdrawal mechanism guides, and wherein the link is configured to maintain a constant distance between the first turning joint and the second turning joint during a rotation of the door.

2. The refrigerator according to claim 1, wherein the second turning joint is closer to the withdrawal mechanism guides than to the reference line.

3. The refrigerator according to claim 1, wherein the second turning joint is configured to be allowed to move relative to the base part in the forward-rearward direction.

4. The refrigerator according to claim 3, wherein the base part comprises a slit extending between the reference line and the withdrawal mechanism guides in the forward-rearward direction, and the rear end of the link is configured to be movable along the slit.

5. The refrigerator according to claim 4, wherein the rear end of the link is spaced apart from a front end of the slit in a state in which the door is closed, and reaches the front end of the slit when the door is turned to a predetermined withdrawal start angle in the state in which the door is closed.

6. The refrigerator according to claim 5, wherein the withdrawal start angle is 70 to 80 degrees.

7. The refrigerator according to claim 1, wherein the link comprises:

a first bent section extending from the front end and bent convexly in a direction away from the turning axis of the door with respect to the cabinet; and a second bent section located between the first bent section and the rear end and bent convexly in a direction opposite the first bent section.

8. The refrigerator according to claim 7, wherein the first bent section and the second bent section are convex in opposite directions with respect to a straight line connecting the front end and the rear end.

9. The refrigerator according to claim 1, wherein a distance between the first turning joint and the second turning joint is longer than a distance between the cabinet and the turning axis of the door.

10. The refrigerator according to claim 1, wherein the withdrawal mechanism guides are disposed between the base part and side surfaces of the storage compartment.

11. The refrigerator according to claim 1, wherein the rear end of the link is connected to a bottom surface of the base part.

* * * * *